US010246978B2

(12) United States Patent
Ziauddin et al.

(10) Patent No.: US 10,246,978 B2
(45) Date of Patent: Apr. 2, 2019

(54) WELL STIMULATION

(71) Applicant: SCHLUMBERGER TECHNOLOGY CORPORATION, Sugar Land, TX (US)

(72) Inventors: Murtaza Ziauddin, Katy, TX (US); Daniel Dias, Abingdon (GB); Danila Kuznetsov, Abingdon (GB); Paul Naccache, Abingdon (GB); Marie Ann Giddins, Abingdon (GB); Suhas Bodwadkar, Abingdon (GB); Abimbola Owodunni, Abingdon (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1095 days.

(21) Appl. No.: 14/243,051

(22) Filed: Apr. 2, 2014

(65) Prior Publication Data

US 2015/0285045 A1 Oct. 8, 2015

(51) Int. Cl.

| | |
|---|---|
| ***G06G 7/48*** | (2006.01) |
| ***E21B 43/16*** | (2006.01) |
| ***E21B 41/00*** | (2006.01) |
| ***E21B 43/25*** | (2006.01) |

(52) U.S. Cl.

CPC ..... *E21B 43/166* (2013.01); *E21B 41/0092* (2013.01); *E21B 43/25* (2013.01)

(58) Field of Classification Search

CPC ..... E21B 43/166; E21B 41/0092; E21B 43/25

See application file for complete search history.

(56) References Cited

U.S. PATENT DOCUMENTS

| | | | |
|---|---|---|---|
| 6,196,318 | B1 | 3/2001 | Gong et al. |
| 7,561,998 | B2 | 7/2009 | Panga et al. |
| 7,603,261 | B2 | 10/2009 | Tardy |
| 7,853,440 | B2 | 12/2010 | Cohen et al. |
| 2003/0225521 | A1 | 12/2003 | Panga et al. |

(Continued)

FOREIGN PATENT DOCUMENTS

| | | | |
|---|---|---|---|
| WO | 2008093264 | A1 | 8/2008 |

OTHER PUBLICATIONS

International Search Report and Written Opinion issued in PCT/US2015/023965 dated Jun. 25, 2015; 10 pages.

(Continued)

*Primary Examiner* — David Silver
*Assistant Examiner* — Russ Guill
(74) *Attorney, Agent, or Firm* — Rachel E. Greene; Michael L. Flynn; Robin Nava

(57) ABSTRACT

A well stimulation modeling method and simulation model for modeling a stimulation treatment involving a chemical reaction between a treatment fluid and a porous medium, such as acid treatment of a carbonate formation. In a wormhole initiation stage or mode, the medium of the cells having a solid saturation above a respective critical solid saturation is comprised of matrix material behaving as a single permeability, single porosity system; and in a wormhole growth stage or mode, the cells having a solid saturation equal to or less than the respective critical sold saturation comprise two different interconnected media, the matrix material and a wormhole material, defined to include wormhole-forming material as well as mature wormholes, having fluid mobility as a function of the solid saturation.

20 Claims, 15 Drawing Sheets

(56) References Cited

U.S. PATENT DOCUMENTS

| | | | |
|---|---|---|---|
| 2010/0314110 | A1 | 12/2010 | Lindvig et al. |
| 2012/0173220 | A1 | 7/2012 | Li et al. |
| 2012/0232872 | A1 | 9/2012 | Nasreldin et al. |
| 2013/0096890 | A1 | 4/2013 | Vanderheyden et al. |

OTHER PUBLICATIONS

Buijse, "Understanding Wormholing Mechanisms Can Improve Acid Treatments in Carbonate Formations", SPE 38166—SPE European Formation Damage Conference, The Hague, Netherlands, Jun. 2-3, 1997, pp. 168-175.

Cohen, et al., "A New Matrix Acidizing Simulator Based On A Large Scale Dual Porosity Approach", SPE 107755—European Formation Damage Conference, Scheveningen, The Netherlands, 2007, pp. 1-14.

Daccord, et al., "Carbonate Acidizing: Toward a Quantitative Model of the Wormholing Phenomenon", SPE 16887 SPE Production Engineering, vol. 4, Issue 1, 1989, pp. 1-6.

De Oliveira, et al., "Numerical Simulation of the Acidizing Process and PVBT Extraction Methodology Including Porosity/Permeability and Mineralogy Heterogeneity", SPE 151823—SPE International Symposium and Exhibition on Formation Damage Control, Lafayette, Louisiana, Feb. 15-17, 2012, pp. 1-9.

Fredd, et al., "Influence of Transport and Reaction on Wormhole Formation in Porous Media", AlChE Journal, vol. 44, No. 9, 1998, pp. 1933-1949.

Fredd, et al., "Validation of Carbonate Matrix Stimulation Models", SPE 58713—SPE International Symposium on Formation Damage Control, Lafayette, Louisiana; Feb. 23-24, 2000, pp. 1-14.

Gdanski, "A Fundamentally New Model of Acid Wormholing in Carbonates", SPE 54719—SPE European Formation Damage Conference, The Hague, Netherlands, 1999, pp. 1-10.

Golfier, et al., "Acidizing Carbonate Reservoirs: Numerical Modelling of Wormhole Propagation and Comparison to Experiments", SPE 68922—SPE European Formation Damage Conference, The Hague, The Netherlands, May 21-22, 2001, pp. 1-11.

Hill, et al., "Fundamentals of Acid Stimulation", Reservoir Stimulation, 3rd Edition, Wiley, 2000.

Hoefner, et al., "Pore Evolution and Channel Formation During Flow and Reaction in Porous Media", AlChE, vol. 34, No. 1, 1988, pp. 45-54.

Hung, et al., "A Mechanistic Model of Wormhole Growth in Carbonate Matrix Acidizing and Acid Fracturing", SPE 16886—Journal of Petroleum Technology, vol. 41, Issue 1, 1989, pp. 1-8.

Maheshwari, et al., "3-D simulation and analysis of reactive dissolution and wormhole formation in carbonate rocks", Chemical Engineering Science, vol. 90, Mar. 7, 2013, pp. 258-274.

Mostofizadeh, et al., "Optimum Injection Rate From Radial Acidizing Experiments", SPE 28547—SPE Annual Technical Conference and Exhibition, New Orleans, Louisiana, Sep. 25-28, 1994, pp. 1-7.

Panga, et al., "Modeling, Simulation and Comparison of Models for Wormhole Formation During Matrix Stimulation o Carbonates", SPE 77369—SPE Annual Technical Conference and Exhibition, San Antonio, Texas, 2002, pp. 1-19.

Panga, et al., "Two-scale continuum model for simulation of wormholes in carbonate acidization", AlChE Journal, vol. 51, No. 12, 2005, pp. 3231-3248.

Wang, et al., "The Optimum Injection Rate for Matrix Acidizing of Carbonate Formations", SPE 26578—SPE Annual Technical Conference and Exhibition, Houston, Texas, Oct. 1993-Jun. 1993, 13 pages.

Warren, et al., "The Behavior of Naturally Fractured Reservoirs", SPE Journal, vol. 3, No. 3, 1963, pp. 245-255.

Zakaria, et al., "Predicting the Performance of the Acid Stimulation Treatments in Carbonate Reservoirs using Non-Destructive Tracer Tests", SPE International Symposium and Exhibition on Formation Damage Control, Lafayette, USA, Feb. 26-28, 2013, pp. 1-27.

Extended European Search Report issued in European Patent Appl. No. 15773546.5 dated Nov. 28, 2017; 5 pages.

WELL STIMULATION

RELATED APPLICATION DATA

None.

BACKGROUND

The statements in this section merely provide background information related to the present disclosure and may not constitute prior art.

Well stimulation using a solution of reactant to dissolve formation media, e.g., acid stimulation of carbonate formations, is used to increase the production of reservoir fluids to the wellbore. The art has long sought modeling techniques and tools to optimize the rate of reactant injection.

If the injection rate is too low, the reactant is spent as soon as it contacts the medium, dissolving only the face of the medium, in a process known as "face dissolution" shown in FIG. 1A. As the injection rate is increased, "conical" dissolution occurs, as seen in FIG. 1B, where the face dissolution is still present and the wormhole is short and wide. As seen in FIG. 1C, at intermediate injection rates, a long, dominant channel running deep in the formation, known as a wormhole, is formed, which is considered the optimum enhancement for flow and is associated with the optimum injection rate. At higher rates more uniform dissolution widens the wormhole as the reactant dissolves the medium over a larger and larger region, as seen in FIGS. 1D and 1E, and a large volume of rock is dissolved by excessive reactant without significant flow improvements.

Given the importance of matrix stimulation in the oil and gas industry, a large number of models, including dimensionless models, capillary tube models, network models and continuum models, have been developed in an effort to predict behavior and optimize injection parameters. Many of these suffer from drawbacks of requiring knowledge of, difficult to obtain parameters, restriction to certain types of reaction regimes, inability to account for wormhole initiation and/or uniform dissolution patterns, requiring enormous computational power to scale to field conditions, difficulty coupling reaction and transport mechanisms, and the like. The art is desirous of modeling methods and tools that overcome one or more of these drawbacks and that can be used to better implement matrix stimulation.

SUMMARY

In some embodiments according to the disclosure herein, a method of forming a wormhole in a porous medium comprises running a stimulation simulator to obtain optimized treatment fluid injection parameters, and injecting the treatment fluid into the treatment region of the porous medium according to the optimized treatment fluid injection parameters to form the wormhole. In some embodiments, the running the stimulation simulator comprises: populating the simulator with static properties of the porous medium and reaction kinetic properties for reaction of the porous medium with a reactant in a treatment fluid; gridding a treatment region of the porous medium into a plurality of cells comprising a first portion designated as matrix cells and a second portion designated as wormhole cells; modeling the matrix cells wherein a medium of the matrix cells comprises matrix material behaving as a single permeability, single porosity system; modeling the wormhole cells in a wormhole initiation stage wherein a medium of the respective wormhole initiation stage cells has a solid saturation above a respective critical solid saturation and is comprised of the matrix material behaving as a single permeability, single porosity system; modeling at least a portion of the wormhole cells in a wormhole growth stage wherein the respective wormhole cells have a solid saturation equal to or less than the respective critical sold saturation, and wherein the wormhole growth stage cells comprise two different interconnected media comprised respectively of the matrix material and a wormhole material having a fluid mobility as a function of solid saturation; and obtaining the optimized treatment fluid injection parameters.

In some embodiments, a method may comprise modeling a stimulation treatment involving a chemical reaction between a treatment fluid and a porous medium in a subterranean formation using a computerized model. The modeling may comprise gridding a treatment region of the subterranean formation into a plurality of cells; modeling the cells in a wormhole initiation stage wherein the medium of the cells having a solid saturation above a respective critical solid saturation is comprised of matrix material behaving as a single permeability, single porosity system; and modeling the cells having a solid saturation equal to or less than the respective critical sold saturation in a wormhole growth stage wherein the cells comprise two different interconnected media comprised of the matrix material and a wormhole material having a fluid mobility as a function of solid saturation.

In some embodiments, a computerized model to simulate a stimulation treatment involving a chemical reaction between a treatment fluid and a porous medium in a subterranean formation may comprise a grid defining a plurality of cells representing a treatment region of the subterranean formation; a wormhole initiation mode wherein the medium of the cells having a solid saturation above a respective critical solid saturation is comprised of matrix material behaving as a single permeability, single porosity system; and a wormhole growth mode wherein the cells having a solid saturation equal to or less than the respective critical sold saturation comprise two different interconnected media comprised of the matrix material and a wormhole material having a fluid mobility as a function of solid saturation.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1A:
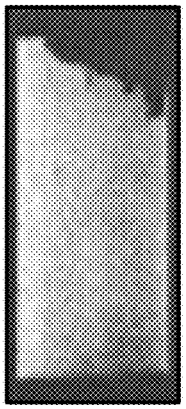
FIG. 1A is a schematic diagram of a face dissolution regime in matrix stimulation at a relatively low injection rate.
Figure 1B:
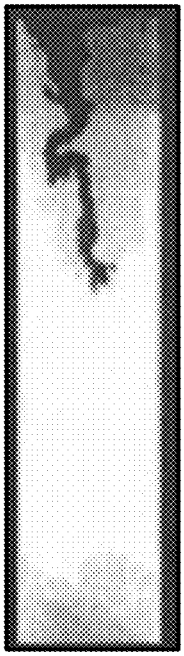
FIG. 1B is a schematic diagram of a conical dissolution regime in matrix stimulation at a less than optimum injection rate higher than that of FIG. 1A.
Figure 1C:
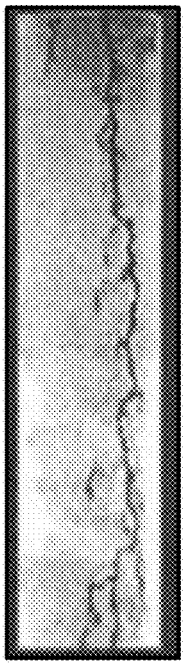
FIG. 1C is a schematic diagram of a wormhole dissolution regime in matrix stimulation at an optimum injection rate according to some embodiments of the current application.
Figure 1D:
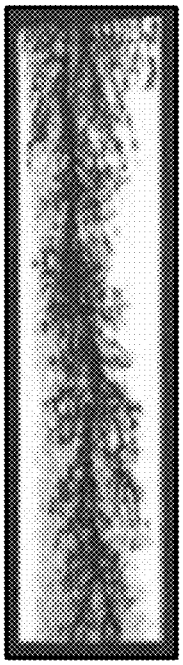
FIG. 1D is a schematic diagram of a ramified dissolution regime in matrix stimulation at an excess injection rate relatively higher than that of FIG. 1C.
Figure 1E:
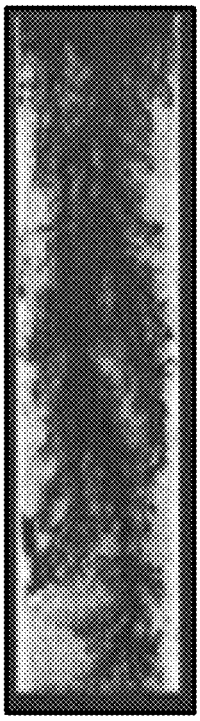
FIG. 1E is a schematic diagram of a unified dissolution regime in matrix stimulation at an excess injection rate relatively higher than that of FIG. 1D.

For the purposes of promoting an understanding of the principles of the disclosure, reference will now be made to some illustrative embodiments of the current application. Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

It should be understood that, although a substantial portion of the following detailed description may be provided in the context of oilfield acid stimulation operations, other oilfield and non-oilfield operations may utilize and benefit as well from the instant disclosure.

Figure 2:
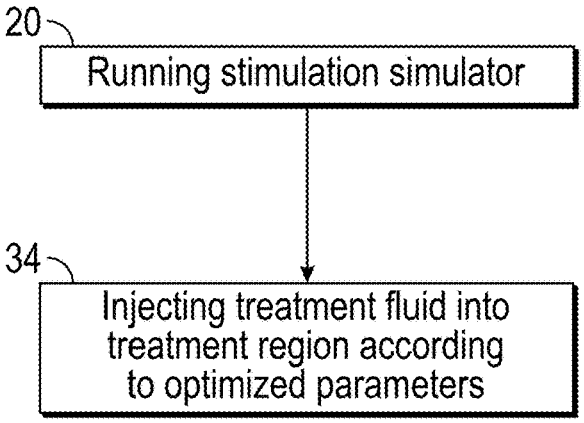
FIG. 2 is a schematic flow diagram for a method of forming a wormhole in a porous medium according to embodiments of the present disclosure.
Figure 3:
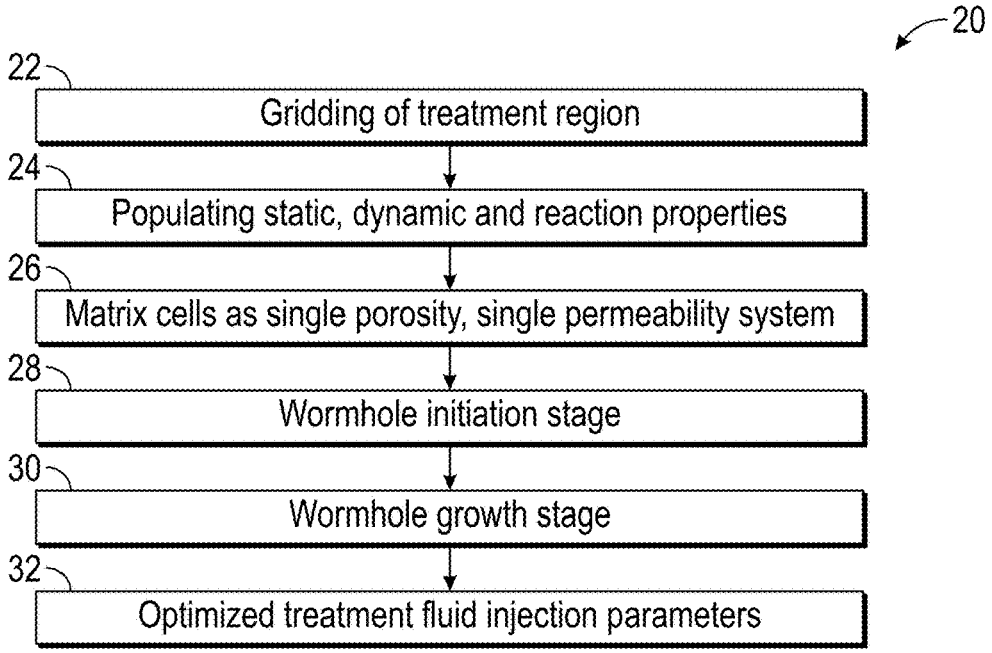
FIG. 3 is a schematic flow diagram for a method of running a stimulation simulator to obtain optimized treatment fluid injection parameters in the method of FIG. 2 according to embodiments of the present disclosure.

According to some embodiments of the present disclosure, and with reference to FIGS. 2 and 3, a method of forming a wormhole in a porous medium comprises running 20 a stimulation simulator comprising: gridding 22 a treatment region of the porous medium into a plurality of cells comprising a first portion designated as matrix cells and a second portion designated as wormhole cells; populating 24 the simulator with static properties of the porous medium, reaction kinetic properties for reaction of the porous medium with a reactant in a treatment fluid and dynamic properties of the fluids; modeling 26 the matrix cells wherein a medium of the matrix cells comprises matrix material behaving as a single permeability, single porosity system; modeling 28 the wormhole cells in a wormhole initiation stage wherein a medium of the respective wormhole initiation stage cells has a solid saturation above a respective critical solid saturation and is comprised of the matrix material behaving as a single permeability, single porosity system; modeling 30 at least a portion of the wormhole cells in a wormhole growth stage wherein the respective wormhole cells have a solid saturation equal to or less than the respective critical sold saturation, and wherein the wormhole growth stage cells comprise two different interconnected media comprised respectively of the matrix material and a wormhole material having a fluid mobility as a function of solid saturation; and obtaining optimized treatment fluid injection parameters. As used herein, "wormhole material" refers to both wormholes per se as well as protowormhole or wormhole-forming material. In some embodiments, the method may further include injecting 34 (see FIG. 2) the treatment fluid into the treatment region of the porous medium according to the optimized treatment fluid injection parameters to form the wormhole.

In some embodiments, the stimulation simulator uses a finite difference numerical method. In some embodiments, the stimulation simulator accounts for the presence in the treatment region of a multicomponent fluid selected from the group consisting of gas, aqueous and oil phases, including combinations thereof. In some embodiments, the stimulation simulator accounts for the presence in the treatment region of a plurality of solid phases. In some embodiments, the treatment region comprises a subterranean formation comprising calcium carbonate rock and the treatment fluid comprises acid delivered to the treatment region through a wellbore penetrating the subterranean formation.

In some embodiments, the fluid mobility as a function of solid saturation is specified independently for each cell to characterize different behaviors of different rock types in the respective cells.

In some embodiments, the wormhole initiation stage modeling accounts for dissolution of the matrix material to increase permeability and pore volume in the respective cells. In some embodiments, the media of the wormhole cells in the wormhole initiation stage modeling comprise the matrix material and the wormhole material, and the wormhole initiation stage modeling further comprises assigning very low values to a matrix-fracture coupling transmissibility multiplier (sigma or $\sigma$) so that the reactant in the treatment fluid does not interact with the wormhole material.

In some embodiments, the media of the cells in the wormhole initiation stage modeling comprise the matrix material and the wormhole material, and the wormhole initiation stage comprises assigning very low initial values to a matrix-fracture coupling transmissibility multiplier so that reactant in the treatment fluid does not interact with the material of the wormhole material, and further comprising transitioning to the wormhole growth stage modeling by increasing the matrix-fracture coupling transmissibility multiplier above the respective initial values.

In some embodiments, reaction of the treatment fluid with the matrix material and, where the solid saturation is equal to or less than the respective critical sold saturation, with the wormhole material, is independently parameterized to account for dissolution of the respective material(s) in the respective cells.

In some embodiments, a reaction rate $R_r$ between the treatment fluid and a solid material in the cells is given by:

$$R_r = V_b \cdot A_r \cdot \Pi c_{ri}^{n_{ri}} \cdot \Pi D_{mijk} \quad \text{Equation (1)}$$

wherein $V_b$ is the bulk volume of the respective cell, $A_r$ is a reaction rate constant, $c_{ri}$ is the product of reactant and solid concentrations, $n_{ri}$ is the order of each concentration term, and $D_{mijk}$ is an equilibrium deviation reaction term given by:

$$D_{mijk} = \theta \cdot (F_k(a_i) - C_a) \quad \text{Equation (2)}$$

wherein $\theta$ is porosity of the respective cell, $F_k(a_i)$ is a function of the reactant concentration and $C_a$ is the solid concentration.

In some embodiments, the stimulation simulator comprises a table of mobility function versus solid saturation.

In some embodiments, the method may further comprise calibrating the stimulation simulator using experimental data derived from a specimen representing rock from the treatment region, such as, for example, to determine a reaction rate function for reaction between the treatment fluid and a solid material in the cells and/or to populate a table of the fluid mobility versus the solid saturation.

In some embodiments, the method may comprise running the stimulation simulator a plurality of times to obtain data points comprising pore volume to breakthrough as a function of treatment fluid injection rate, such as, for example, to determine the treatment fluid injection rate corresponding to a minimum pore volume to breakthrough.

In some embodiments, the treatment region comprises a near-wellbore region of the treatment region in a subterranean formation, e.g. a region comprising a single injection or source well, and further comprising running the stimulation simulator to determine an optimum treatment fluid injection rate to treat the near wellbore region. The near wellbore region may extend from the wellbore up to about 35 m, or from the wellbore up to 3.5 m.

In some embodiments, the treatment region comprises a sector of a subterranean formation, and the optimized treatment fluid injection parameters comprise an optimum treatment fluid injection rate to treat the sector. As used herein "sector" is defined as a single injection source and the region within an arbitrary distance of the injection source. Said distance may be from about 35 m to about 1 km, or 35 m to 500 m, or 35 m to 100 m.

In some embodiments, the treatment region comprises a field of a subterranean formation, e.g., a plurality of injection and/or production wells, and wherein the optimized treatment fluid injection parameters comprise an optimum treatment fluid injection rate to treat the field.

In some embodiments, a method comprises modeling a stimulation treatment involving a chemical reaction between a treatment fluid and a porous medium in a subterranean formation using a computerized model, comprising: gridding a treatment region of the subterranean formation into a plurality of cells; modeling the cells in a wormhole initiation stage wherein the medium of the cells having a solid saturation above a respective critical solid saturation is comprised of matrix material behaving as a single permeability, single porosity system; and modeling the cells having a solid saturation equal to or less than the respective critical sold saturation in a wormhole growth stage wherein the cells comprise two different interconnected media comprised of the matrix material and a wormhole material having a fluid mobility as a function of solid saturation.

In some embodiments, a computerized model to simulate a stimulation treatment involving a chemical reaction between a treatment fluid and a porous medium in a subterranean formation, comprises: a grid defining a plurality of cells representing a treatment region of the subterranean formation; a wormhole initiation mode wherein the medium of the cells having a solid saturation above a respective critical solid saturation is comprised of matrix material behaving as a single permeability, single porosity system; and a wormhole growth mode wherein the cells having a solid saturation equal to or less than the respective critical sold saturation comprise two different interconnected media comprised of the matrix material and a wormhole material having a fluid mobility as a function of solid saturation.

According to some embodiments of the present disclosure, a stimulation simulator can account for both wormhole initiation and growth by initially considering the modeled region to be a single media until a criterion for initiation of wormhole(s) is met, after which the model seamlessly transitions into a dual-permeability approach of matrix and wormhole(s). In some embodiments the two media are considered at a Darcy-scale, permitting application to a core, near-wellbore (single-well) or field scale (multiple well) simulation with minimal effort. In some embodiments, the simulations can be done using as the basis for the model, commercially available reservoir simulators such as ECLIPSE, NEXUS, CMG IMEX, CMG GEM, CMG STARS, MRST, OPM and the like, providing flexibility to use either black oil or other compositional models; Fully Implicit, IMPES or AIM formulations, advanced modeling features such as local grid refinements, among others, so that flow may be solved by a finite difference method applied to a combination of Darcy and mass balance equations.

Figure 4:
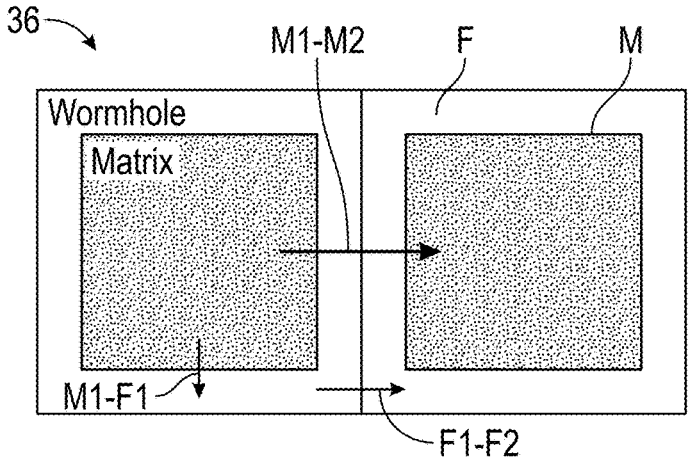
FIG. 4 schematically illustrates a dual permeability model according to embodiments of the current application.

According to some embodiments, the model starts with the basic assumption that initially only matrix exists, so the behavior of a single permeability, single porosity system is initially started, and after certain dissolution of the matrix material occurs, a transition is made to a model where two different interconnected media exist: matrix and wormhole. In some embodiments, a volume ratio between them is assumed, e.g., using net-to-gross (NTG) variables. This is enabled through a dual permeability approach based on the dual permeability model 36 shown in FIG. 4, wherein the flow arrows show the possible flow connections between matrices M and wormholes F of adjacent cells, e.g., M1-F1, M1-M2 and F1-F2. Note in the classical dual-permeability model, the flows are between a fracture and the matrix M, but according to the present disclosure the wormhole F is modeled as the fracture component.

The phases present in the model may vary according to practical use. In some embodiments, phases are a multicomponent fluid phase, e.g., carrier fluid such as water or oil, reactant and reactant products, and a porous or permeable solid phase, e.g., material such as rock reactive with the reactant. Chemical reactions to model the dissolution take place in both matrix and wormhole media, in some embodiments. In the following description when water and acid and carbonate or calcite rock are mentioned, it is as an exemplary multicomponent fluid phase and an exemplary solid phase, it being understood the disclosure is not limited thereto since the model may be modified to suit virtually any fluid/immobile solid phase, or fluid/rock, pair as desired. Optional oil and gas phases may be present as desired in some embodiments, either in black oil or compositional formulations.

Calcium carbonate is dissolved by hydrochloric acid as described in Equation 3 or the more simplified form of Equation 4 where all the products are grouped into a single aqueous component.

$$2HCl+CaCO_3 \rightarrow CaCl_2+CO_2+H_2O \qquad \text{Equation (3)}$$

$$2HCl+CaCO_3 \rightarrow \text{Water with Dissolved Products} \qquad \text{Equation (4)}$$

The reaction rate for dissolution is given by Equations 1 and 2 mentioned above. As the reaction takes place, $CaCO_3$ is dissolved, and the solid saturation in the cell decays. This plays different roles in each of the media, but first an important distinction is made between two different stages: wormhole initiation and wormhole growth.

Figure 5:
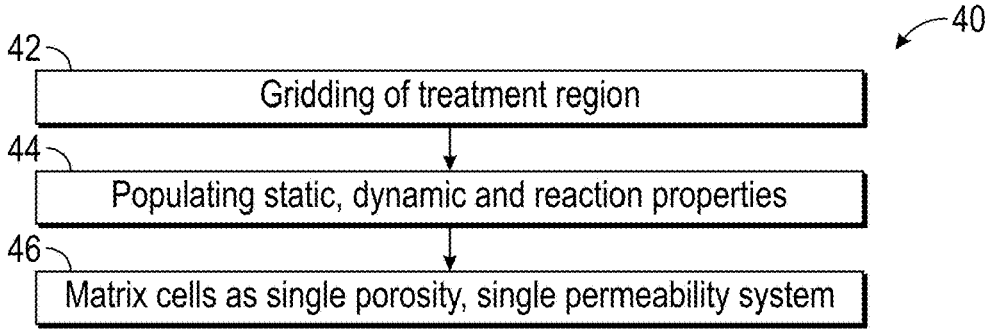
FIG. 5 is a schematic flow diagram of a modeling method according to embodiments of the current application.

With reference to FIG. 5, according to some embodiments the simulation 40 may begin with an appropriate gridding 42 of the proposed treatment region to be modeled into a plurality of cells, followed by modeling 44 the cells in a wormhole initiation stage wherein the medium of the cells having a solid saturation above a respective critical solid saturation is comprised of matrix material behaving as a single permeability, single porosity system, and modeling 46 the cells having a solid saturation equal to or less than the respective critical solid saturation in a wormhole growth stage wherein the cells comprise two different interconnected media comprised of the matrix material and a wormhole material having a fluid mobility as a function of solid saturation. The grid may include 1, 2 or 3 dimensions, and may be gridded in Cartesian, radial, spherical, or corner-point grid coordinate systems best suited for the proposed treatment region. In some embodiments, the model may include an artificial division of a portion of the cells designated matrix cells, which remain matrix cells throughout the modeling process where fluid mobility is not increased despite acid dissolution of a portion of the matrix medium, and the remaining portion of the cells into wormhole cells, which may transition from a wormhole initiation stage where they behave as matrix cells into a wormhole growth stage where they behave as dual media, dual permeability cells depending on solids saturation. The gridding may, in some embodiments, also include a cell(s) corresponding to a source(s) of acid or injection well(s), and optionally cell(s) corresponding to acid sink(s) or production well(s). In some embodiments, the source(s) and/or sink(s) may be disposed as buffer cell(s) at the borders or margins of the modeled treatment region.

The method may also include, in some embodiments, populating 22 of the simulator with petrophysical properties of the simulated treatment region, such as porosity, permeability and net-to-gross ratios. These data may be obtained from experimental data or direct measurement of the treatment region and/or core samples representative of the treatment region. Where experimental data or direct measurements are not available, the properties may be estimated in accordance with geophysical estimating methodologies. For an example, the treatment region may be considered as having homogeneous or heterogeneous properties. In some embodiments, permeability of the matrix may be calculated from the initial pressure drop in a core sample using Darcy's law.

At the start of the wormhole initiation stage 30, the model according to some embodiments behaves as single permeability single porosity. When acid enters into the model via a source, such as, for example, an injection well, the connections, for example the well completions are defined in such a way that the source only contacts the matrix. In some embodiments, the matrix is artificially divided into two media, one being the precursor of the collection of wormholes, which are collectively referred to as 'wormhole'. At this point, the media are considered isolated from each other, so that no acid can reach the wormhole precursors. This is done by assigning very low values, e.g., 0.01, 0.001, 0.0001, 0.00001, or 0.000001 or the like, to a variable referred to herein as the matrix-wormhole coupling transmissibility multiplier, or sigma ($\sigma$), which is analogous to the multiplier matrix-fracture coupling transmissibility multiplier used in fracture-matrix simulations.

The chemical reaction initially takes place in the matrix M, with no permeability enhancement occurring. After a certain amount of material is dissolved from the matrix, the model considers that the pores have reached a size large enough to equal or exceed a critical pore size corresponding to a critical solids saturation level, after which the model transitions to a model 36 wherein wormholes F can begin initiation. A multiplier is then applied to sigma to restore its value to unity in the respective cells, allowing the acid in the model to reach the second wormhole medium and start to create the wormhole. This corresponds to a transition into a dual-porosity, dual-permeability model stage 28, also called the wormhole growth stage.

Once acid reaches the wormhole cells wherein sigma is unity, the wormhole growth stage 30 begins. Acid transport and reaction now take place in both matrix and wormhole media M, F, effectively competing for the available acid, however permeability enhancement in some embodiments is limited to the wormhole F. This is equivalent to assuming in some embodiments that the matrix M dissolution does not form connected channels that would significantly enhance the flow. This is controlled in some embodiments by a table of mobility multiplication versus solid saturation, which may be obtained by experimental tests, e.g., by using a core sample from the proposed treatment region or representative of the treatment region, as mentioned above. In this stage the wormhole permeability changes with time. In some embodiments, maximum wormhole permeability may also obtained from Darcy's law; with an equivalent permeability calculated using a volume weighted arithmetic averaging (Equation 5) and taking into account the final experimental pressure drop.

$$k_f = \frac{k - NTG_m \cdot k_m}{NTG_f} \qquad \text{Equation (5)}$$

$k$ = permeability, mD $NTG$ = net-to-gross, dimensionless $m$, $f$ = matrix and wormhole respectively The NTG ratio, i.e., the volume fraction of the core considered as permeable matrix or permeable wormhole, in some embodiments may be estimated through visual inspection of metal casts from core flooding experiments.

Wormholes F may be considered as a single cluster, that is, they may not be discretely represented.

In some embodiments, the wormhole propagation may start from the beginning, i.e. there is no induction period and thus the critical solids saturation is similar to the initial solids saturation. In these embodiments, the wormhole initiation may be simulated by specifying a higher multiplier for the mobility versus solid saturation in the wormhole region.

The model in some embodiments may be initially considered where the core is saturated with water or other reservoir fluid composition, with the exception of an injection buffer cell corresponding to the injection well, which may contain an acid solution or other fluid equivalent to the treatment fluid being injected. Because of the acid dissolution of the matrix material, the solid volume is transformed into fluid volume, thus increasing the fluid space porosity.

Initially, the matrix and wormhole cells in some embodiments may be both modeled in stage 20 as comprised of matrix material behaving as a single permeability, single porosity system. When a representative volume composed of a single cell or an arbitrary group of cells reaches an average solid saturation equal to the respective critical solid saturation of the cell or group of cells, wormhole growth stage 30 begins. Once the wormhole growth period 30 is started, the reaction between the HCl and the calcium carbonate in the rock continues to take place in the wormhole, dissolving the solid, and thus decreasing solid saturation. The simulator then considers that the mobility of any fluid in that cell would be multiplied by a factor, the mobility multiplier, which was a function of the solid saturation, which in some embodiments may be provided to the simulator in tabular form, based on experimental data where available.

In some embodiments, the initial solids saturation of a cell may initially correspond to a mobility multiplier of 1.0, and as the solid saturation decreases below a critical solids saturation as the rock is dissolved, the mobility multiplier is increased according to the mobility multiplier function or table. At a given saturation, the wormhole cells in some embodiments may reach a maximum permeability, determined experimentally or estimated, which is thereafter applied.

Figure 6:
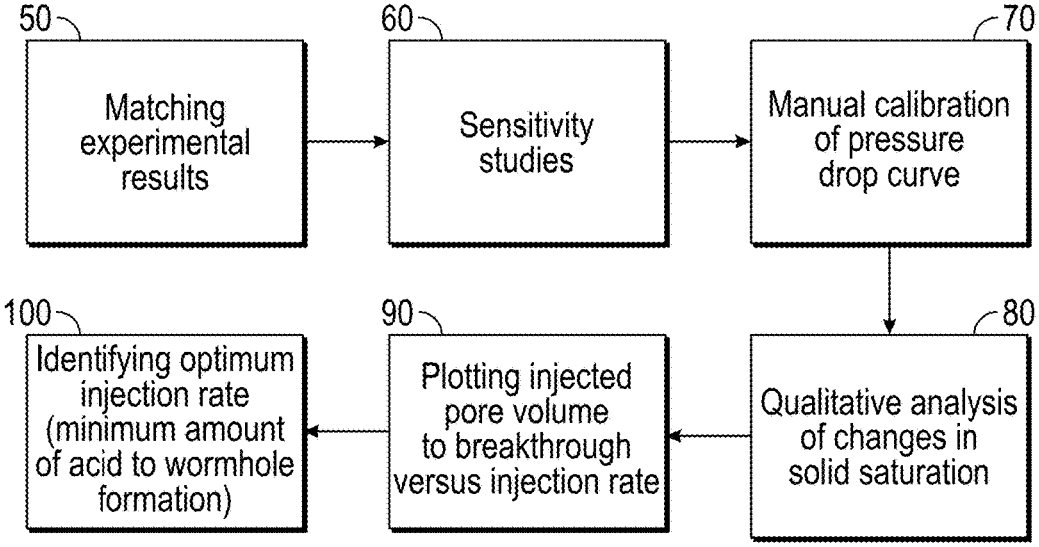
FIG. 6 is a schematic flow diagram of a workflow technique using experimental results from a representative specimen and simulations to perform sensitivity studies, calibrate the model, provide qualitative analysis, and determine optimum injection rate, according to embodiments of the current application.

In some embodiments as shown in FIG. 6, experimental results 50 from core flooding studies may be obtained, e.g., by injecting the reactant solution into a cell containing a core sample representative of the subterranean formation or other medium to be treated. To match the experimental results 50 with the simulator, sensitivity studies 60 may be undertaken in some embodiments to determine the impact of different parameters in the shape of the pressure drop curves. With that knowledge, a manual matching process 70 may be followed until a calibrated curve is obtained to the desired precision. Sensitivity studies 60 in some embodiments may be initially conducted using a specified injection rate. Initially, in some embodiments the condition of the 'closed wormhole' saturation, i.e., the solid saturation at which the wormhole fluid mobility starts increasing situ, may be considered. This may provide curves of the simulated pressure drop across the treatment region versus the cumulative injected pore volume, from which the curve most closely approximating experimental data may be manually matched to provide the critical solids saturation at which the wormhole mobility starts increasing.

Next, the manual matching technique may be used in some embodiments in series to determine the sensitivity of the pressure drop curve to the open wormhole saturation; the wormhole reaction rate constant A in Equation 1 for the wormhole cells; the matrix reaction rate constant for the wormhole cells; the wormhole initiation saturation, i.e., the average saturation of an arbitrary group of cells below which the matrix cells and wormhole cells start to communicate; the matrix-wormhole transmissibility multiplier, i.e., the multiplier for transmissibility between the matrix cell and the wormhole cell, also known as σ; and the like.

With the knowledge of baseline values gained from the sensitivity studies 60, a manual calibration 70 of the pressure drop curve may be performed in some embodiments. In some embodiments, the same injection rate and base case values can be used and allow for the following variables to be changed, in the determined order of relative importance: a. Wormhole reaction rate constant; b. Closed wormhole saturation; c. Matrix reaction rate constant; and d. Open wormhole saturation. In some embodiments, the intermediate points in the mobility multiplier versus solid saturation table may, if desired, be fine-tuned, and the simulations repeated until a good match of the slope of the pressure drop curve is observed.

In some embodiments, a plot may be prepared of the solid saturation for the first designated matrix cell versus the experimental pressure drop to identify the wormhole initiation saturation trigger, i.e., the variable shifting the pressure drop decline curve horizontally, as seen from the sensitivity studies 60. These values may then be applied to simulations corresponding to experiments at different injection rates and the results compared against the experimental data, repeating until a consistent match is obtained for the selected experiments.

The best match obtained in some embodiments may provide the best values for use in the model of the matrix reaction rate constant, the wormhole reaction rate constant, the wormhole initiation solids saturation, the mobility multiplier versus solid saturation table, and/or the matrix-fracture transmissibility multiplier. In some embodiments, one or more of the parameters may be considered as fixed, e.g., the matrix-fracture transmissibility multiplier may be taken as 1.0 where this is not considered as an uncertain parameter.

The parameter values obtained from calibration 70 may in some embodiments be used in the simulator and the results for pressure drop profile and pore volume to breakthrough compared against experimental results. It is worth noting that this set of parameter values may not be unique, but rather one possible outcome of several relevant solutions. Additional experimental measurements, if desired, may be undertaken to further validate or obtain more accuracy in the parameters.

If desired the derived parameters may be used in a qualitative analysis 80, to determine the change in solid saturation in matrix cells and wormhole cells at the start and end of injection for the different injection rates considered. The qualitative analysis 80 should confirm that very little dissolution occurs at the face of the core, for example, as reflected in a short change in the matrix medium, with the wormhole progressing through the entire core. In some embodiments, the pressure drops for the various injection rates obtained through simulation may be plotted against experimental results to confirm good agreement between experimental and simulation results, especially the existence of the initial pressure drop decline plateau and the breakthrough point.

With the model properly calibrated with the experimental results, the method includes in some embodiments plotting 90 the injected pore volume to breakthrough versus injection rate. This can be in some embodiments an effective tool for stimulation design to obtain an optimum injection rate corresponding to the injection rate where the least amount of fluid can be injected to obtain maximum permeability enhancement, which is often correlated to the formation of a single wormhole. The pore volume to breakthrough is the amount in pore volumes of acid injected after which no further significant reduction in pressure drop can be observed. In some embodiments, the previously noted agreement between experimental data and simulation results can be reflected in this plot. In some embodiments, additional simulated points may be obtained by running the simulation at additional injection rates, which can identify 100 an optimum injection rate to obtain the minimum amount of acid to be injected to obtain the wormhole formation.

The simulator thus provides a tool for successful acid matrix stimulation design, for example, the parameters from the simulator may be applied to treat a subterranean formation with the optimum acid injection rate determined by modeling the proposed treatment region. The use of a commercially available numerical simulator allows for flexibility of use, which leads to a wide range of potential applications such as well and field scale simulation to predict production enhancement from stimulation, which may include applications with heterogeneous properties as well as different rock-fluid pairs in 1, 2 or 3 dimensions.

According to embodiments, the method may be used with homogeneous or heterogeneous properties. According to some embodiments, when the properties are heterogeneous, stochastic methods may be used to generate equal probability realizations of petrophysical properties, e.g., porosity, permeability and the like. To assess the representativeness of a specific realization or of a group of realizations generated by predefined input parameters, some embodiments may allow for screening based on the inclusion of experimental tracer data, referred to here as the "tracer response-based screening workflow."

Figure 7:
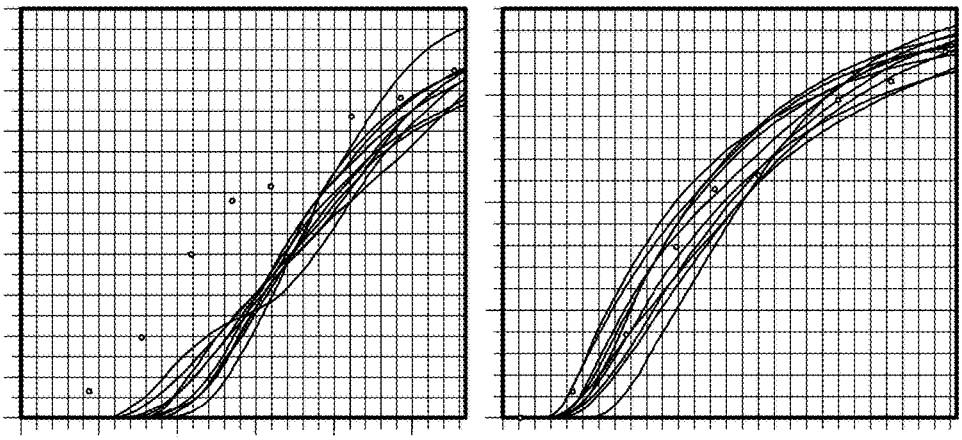
FIG. 7 compares tracer breakthrough curves and pressure drop measurements to simulation data according to embodiments of the current application.

In the tracer response-based screening workflow, the tracer response experimental data may be validated by performing a numerical simulation in which the core model initially contains carrier fluid such as water, for example, and is then flooded by a like carrier fluid containing a non-reactive tracer material, modeled as an additional carrier fluid component, at a specific concentration. From this simulation, available experimental data such as tracer breakthrough curves and pressure drop measurements can be compared to the simulation data as illustrated in FIG. 7, which shows typical comparison results for different sets of realizations. The error can be quantified with Equation 6.

$$Err = \sqrt{\sum \frac{(S_i - O_i)^2}{\sigma_i}} \qquad \text{Equation (6)}$$

wherein Err is the total error residual for the simulation in respect to the experimental data, $S_i$ are the individual result data points obtained from the numerical simulation, $O_i$ are the individual experimental data points, and $\sigma_i$ is a weighting parameter which can be applied to each independent data point pair.

Figure 8:
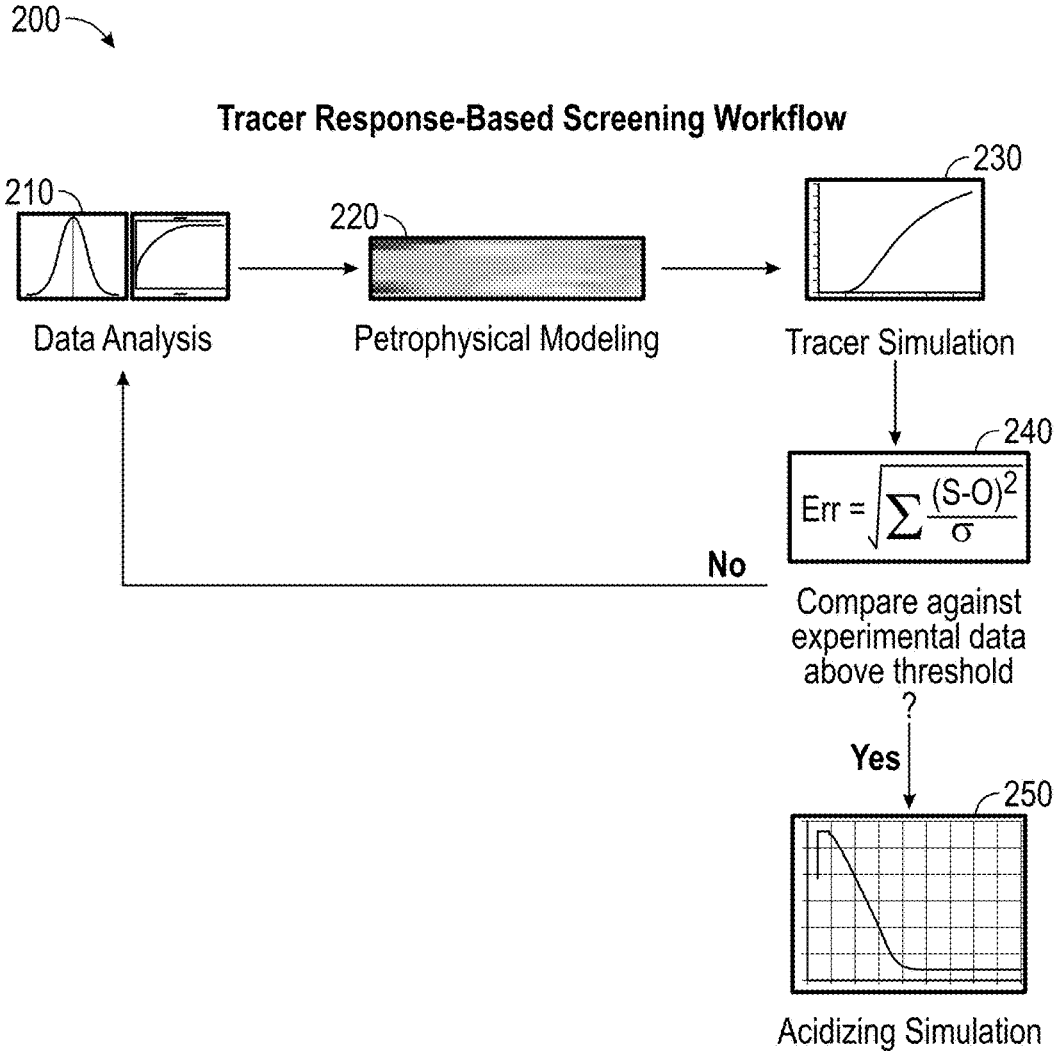
FIG. 8 is a schematic flow diagram of a tracer response-based screening workflow according to embodiments of the current application.

According to some embodiments, a threshold value can then be used to screen the realizations, eliminating any sets which do not meet the criterion and would therefore not be suitable candidates for further calibration in the acidizing studies. As mentioned, this may be used to screen a particular realization or a full set of stochastic realizations created from the same input parameters. FIG. 8 presents an overview of the workflow 200 comprising iterative data analysis 210, petrophysical modeling 220, tracer simulation 230, error analysis 240 and, when the error meets accuracy criteria, ultimately conducting acidizing simulation 250.

EXAMPLES

This example models the behavior of hydrochloric acid flooding experiments performed in Pink Desert limestone core samples described in Zakaria, A. S., Nasr-El-Din, H. A. & Ziauddin, M., 2013. *Impact of Pore-scale Heterogeneity on Carbonate Stimulation Treatments.* Lafayette, SPE. Cylindrical (3.8 cm (1.5 inch) in diameter by 15.2 cm (6 inch) in length, with a total 174 $cm^3$ of bulk volume) core samples held at a temperature of 65.6° C. (150° F.) were initially flooded with water. This water was displaced by a hydrochloric acid solution (15% by weight), which dissolved the rock. The pressure drop across the core was recorded and used for model validation. The experiment was repeated for different injection rates (2.0, 5.0 and 7.5 $cm^3$/min) using different samples of similar characteristics.

A numerical model implemented in an ECLIPSE reservoir simulator was used to represent acid matrix stimulation. Model characteristics included the use of dual permeability, chemical reactions, a multicomponent water phase, a solid phase and a mobility multiplier as a function of solid saturation.

Figure 9:
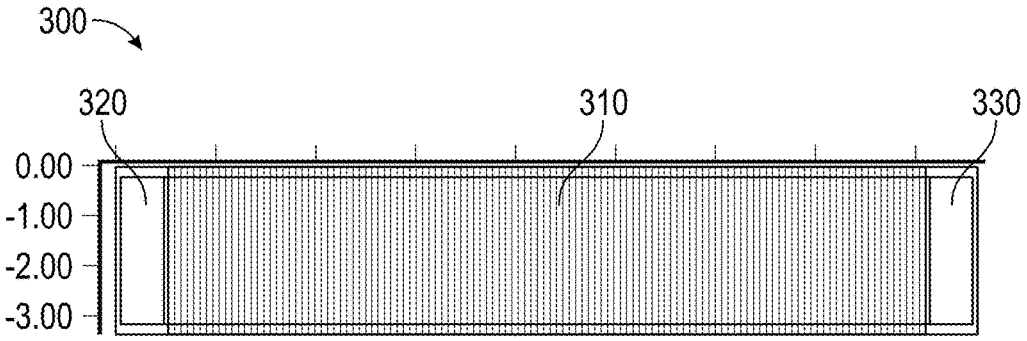
FIG. 9 is a gridding diagram for a core sample simulation in the example according to embodiments of the current application.

The grid 300 used is shown in FIG. 9 and consisted of a total 2,004 cells 310, half of which were alternatingly designated as matrix material and half of which were alternatingly designated as wormhole material. At each border there were two large buffer cells to represent fluid injection 320 and production source 330.

The total core length (15.24 cm) was discretized into 1,000 central cells of $\Delta x$=0.1524 mm each. The other two lengths were calculated to create a square cross-sectional area equivalent to the circle in the core sample, giving $\Delta y=\Delta z$=3.376 cm. Matrix cells and wormhole cells had the same sizes, which was modified using a net-to-gross variable (NTG), which is defined as the fraction of respective volume type (matrix or wormhole) based on the total volume of the core or formation.

To characterize the model, petrophysical properties such as porosity, permeability and net-to-gross were used. Due to lack of experimental data, the model was taken as homogeneous in this example; however the model can support heterogeneous properties as well. The static properties used to characterize the model are summarized in Table 1.

TABLE 1

Static properties for Pink Desert core samples at different injection rates

| | Injection rate | | |
|---|---|---|---|
| Property | 2.0 mL/min | 5.0 mL/min | 7.5 mL/min |
| Porosity, % | 23 | 24 | 26 |
| Pore volume, mL | 40 | 42 | 45 |
| Permeability, mD | 43 | 51 | 74 |
| Max. wormhole permeability, mD | 8,833 | 26,489 | 38,245 |
| Matrix net-to-gross, % | 99 | 99 | 99 |
| Wormhole net-to-gross, % | 1 | 1 | 1 |

The permeability was calculated from the initial pressure drop in the experiment with the use of Darcy's law. It was applied initially to the whole grid, but the wormhole permeability changed with time. Therefore maximum wormhole permeability was also obtained from Darcy's law; with an equivalent permeability calculated using a volume weighted arithmetic averaging (Equation 5) and taking into account the final experimental pressure drop.

$$k_f = \frac{k - NTG_m \cdot k_m}{NTG_f} \quad \text{Equation (5)}$$

$k$ = permeability, mD $NTG$ = net-to-gross, dimensionless $m$, $f$ = matrix and wormhole respectively The NTG ratio, i.e., the volume fraction of the core considered as permeable matrix or permeable wormhole, was estimated through visual inspection of metal casts from experiments.

The model initially considered the core to be saturated with water, with the exception of the injection buffer cell which contained an acid solution equivalent to the one being injected, i.e., 15% HCl by weight. The cells representing the core sample also contained 50% of their pore volume as reactive solids, e.g. for a cell of 1 m3 in bulk volume and 46% porosity assigned, 0.23 m3 would be fluid pore volume, 0.23 m3 would be reactive rock and the remaining 0.54 m3 unreactive rock. Accordingly, the value of the usual petrophysical porosity input were doubled, as half of it would be allocated for reactive solid material.

Two simulated wells were inserted in the model: an injector as the leftmost cell and a producer as the rightmost cell. The injector can be thought of as a source for acid to the core and the producer as a sink. The injector source provided 15% by weight HCl solution at a constant rate, i.e., 2.0, 5.0 or 7.5 mL/min depending on the experimental run, and the producer well was maintained a constant pressure of 100 atm. The maximum timestep was set to 3.6 seconds.

Figure 10:
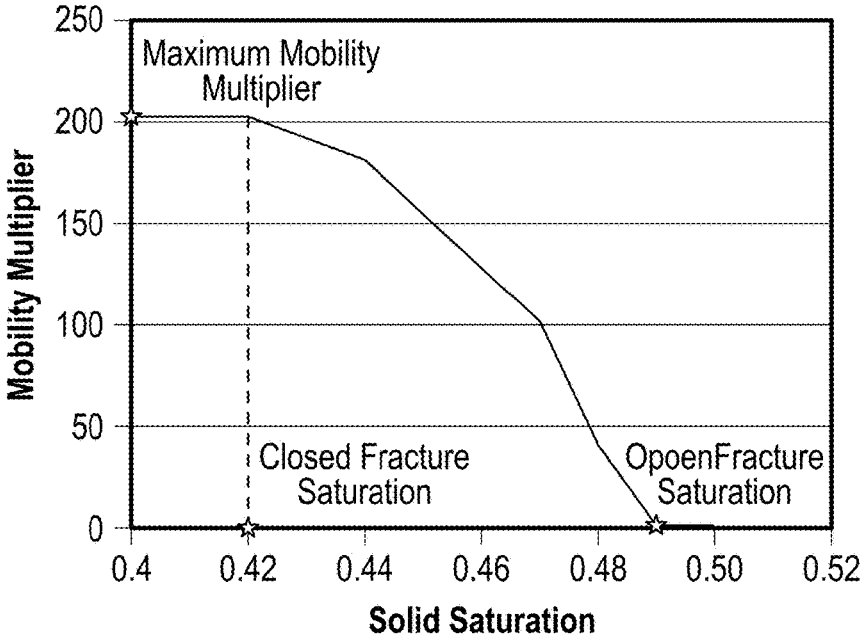
FIG. 10 is a graphical representation of a mobility multiplier table for a wormhole as a function of solid saturation in the example according to embodiments of the current application.

Initially, the matrix and wormhole cells were both modeled as comprised of matrix material behaving as a single permeability, single porosity system. When a representative volume [of a particular wormhole cell or an arbitrary group of cells] reached an average solid saturation equal to the respective critical solid saturation of the cell or group of cells, taken as 50% in this example. Once the wormhole growth period started, the reaction between the HCl and the calcium carbonate in the rock continued to take place in the wormhole, dissolved the solid, and thus decreased solid saturation. The simulator then considered that the mobility of any fluid in that cell would be multiplied by a factor, the mobility multiplier, which was a function of the solid saturation. FIG. 10 shows a graphical representation of an example of this information, which was provided to the simulator in tabular form.

If the cell was initially at 50% solid saturation as in this example, this corresponded to a mobility multiplier of 1.0 As the solid saturation decreased below 49% as the rock dissolved, the mobility multiplier increased. At a given saturation, 42% in this example, the wormhole cells reached their maximum permeability as defined in Table 1, and the maximum multiplier, 203.21, was applied. To use the same table for different experiments, an additional multiplier defined on a cell basis was used, in a manner similar to relative permeability endpoint scaling.

To match the experimental results with the simulator, sensitivity studies were undertaken to determine the impact of different parameters in the shape of the pressure drop curves. With that knowledge, a manual matching process was followed until a calibrated curve was obtained to the desired precision. Sensitivity studies in this example were conducted using the 2.0 mL/min injection rate. Initially, we considered the 'closed wormhole' saturation, i.e., the solid saturation at which the wormhole fluid mobility starts increasing. The results are seen in FIGS. 11 to 16.

The base case value of the closed wormhole saturation in this example was 50%, at which it was seen there was an instant mobility increase. These data show the closed wormhole saturation has an influence in the slope; however, its largest influence is the cumulative injected pore volumes at onset of the lower plateau of the pressure drop. The results in this example are very sensitive to this value: a change in the third decimal impacts the results. The lower the value, the harder it will be to obtain pressure drop.

Figure 11:
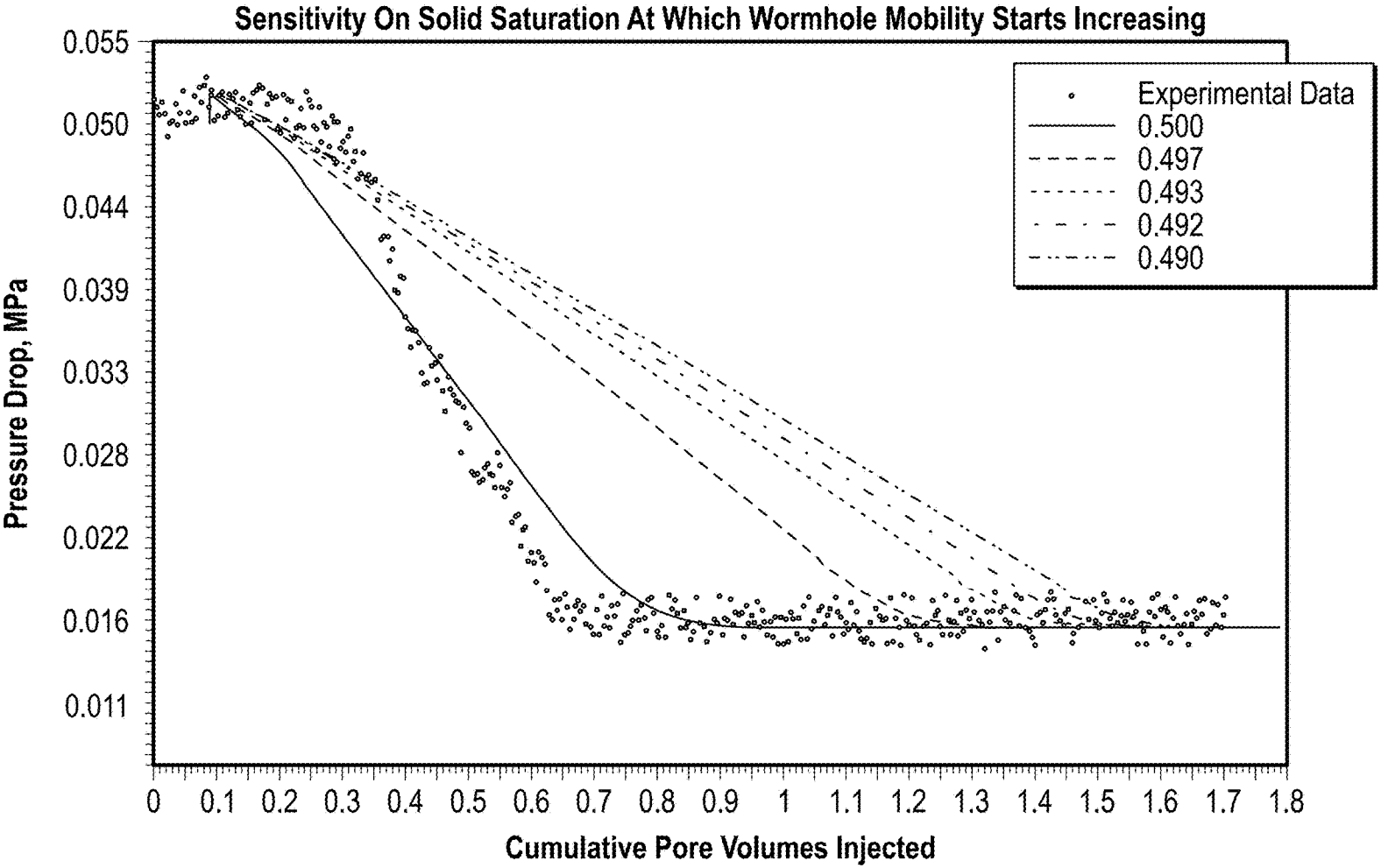
FIG. 11 is a graphical representation of a sensitivity study of the solid saturation at which the wormhole mobility starts increasing in the example according to embodiments of the current application.
Figure 12:
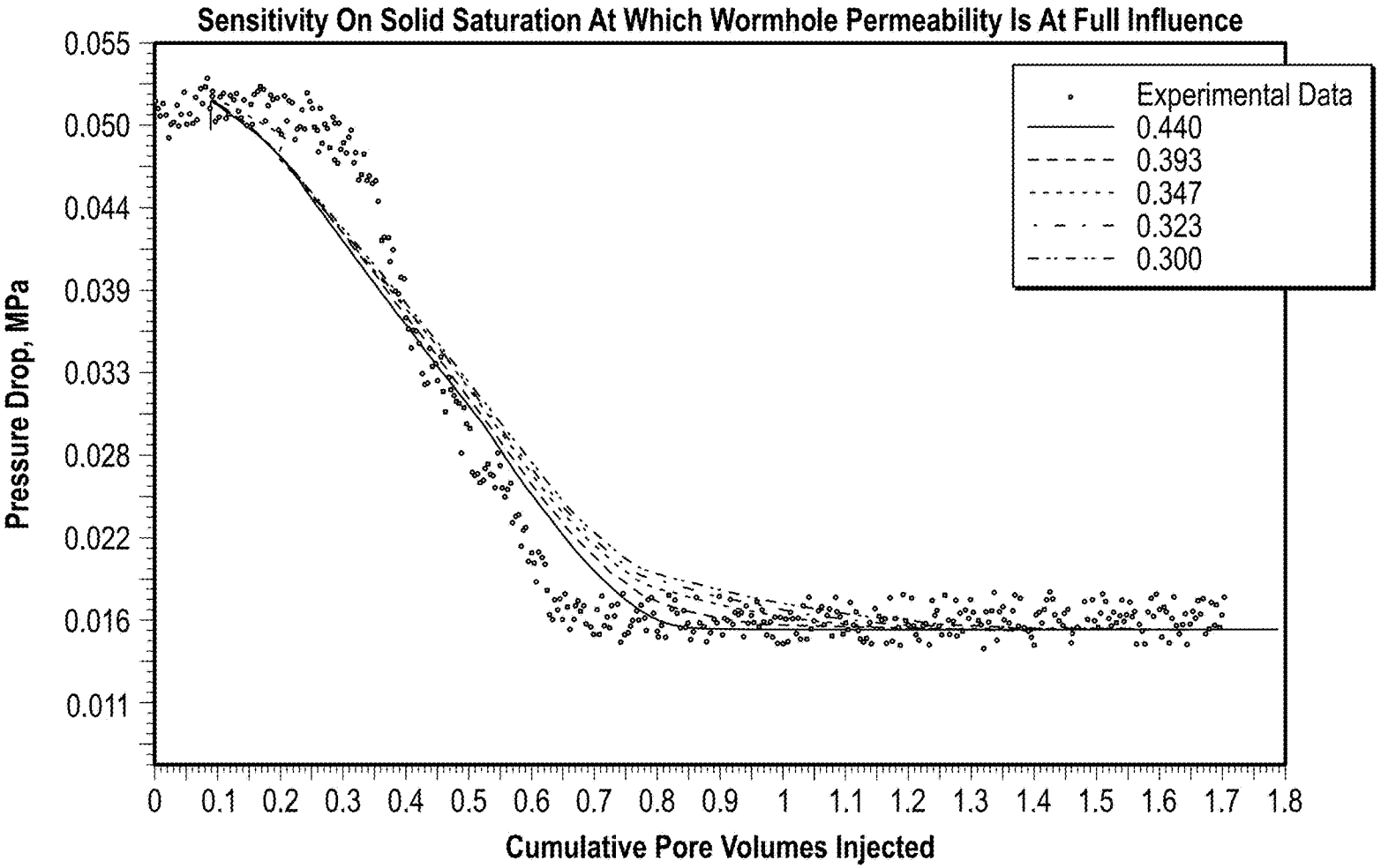
FIG. 12 is a graphical representation of a sensitivity study of the solid saturation at which the wormhole permeability is at full influence in the example according to embodiments of the current application.

Next, we considered the sensitivity of the pressure drop curve to the open wormhole saturation. The results are seen in FIGS. 11 and 12.

The open wormhole saturation in this example had the smallest relative impact in comparison with the other variables in this example, but it did change the shape of the curve close to breakthrough. It is noted that lower saturations would not be reached until dissolution has progressed to a certain extent. The higher this saturation was, the easier it was for the lower pressure drop plateau to be reached.

Figure 13:
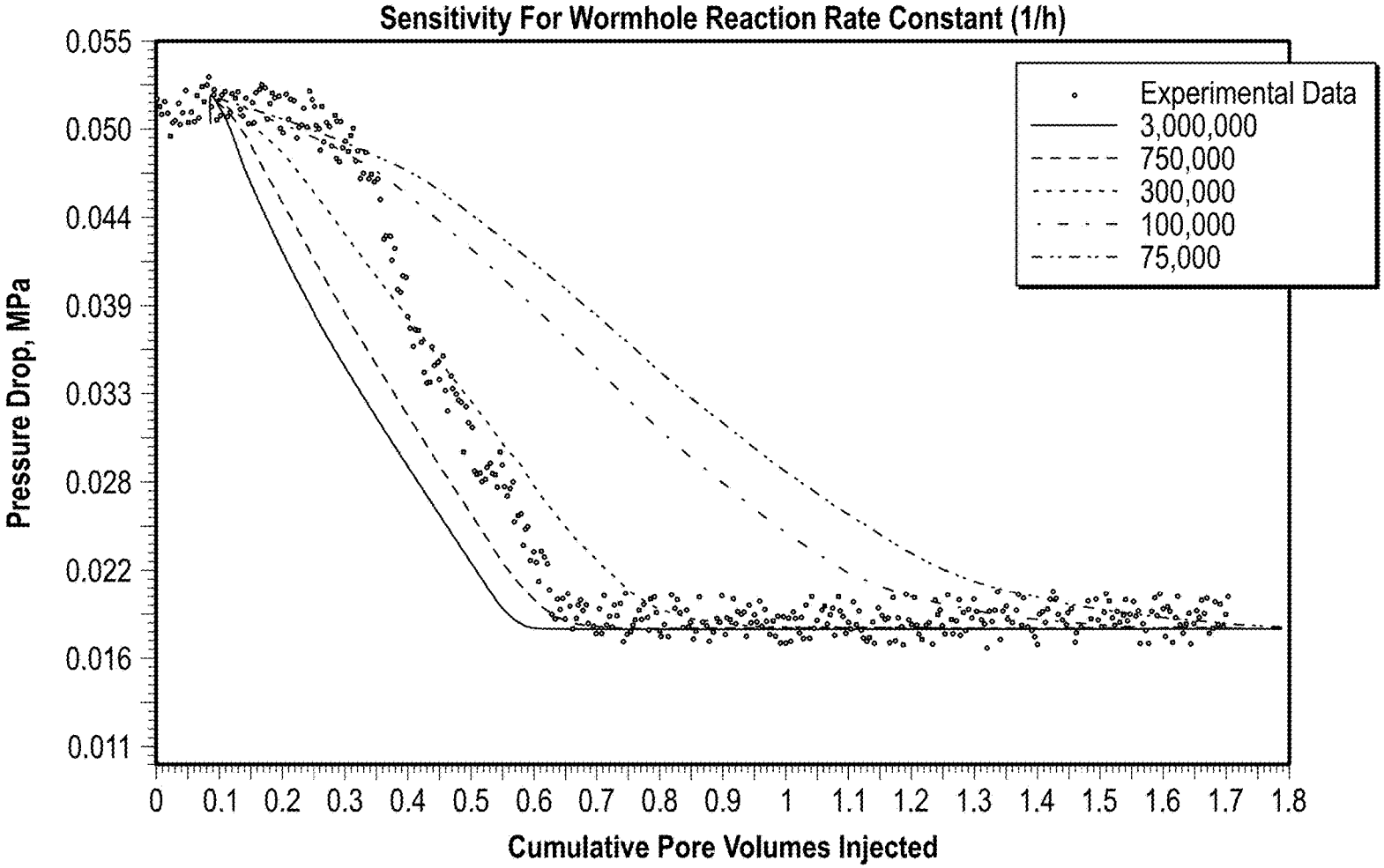
FIG. 13 is a graphical representation of a sensitivity study of the wormhole reaction rate constant in the example according to embodiments of the current application.

Next we considered the sensitivity of the pressure drop curve to the wormhole reaction rate constant A in Equation 3 for the wormhole cells. The results are seen in FIG. 13. The base case value in this example was 300,000 l/h.

The wormhole reaction rate constant strongly altered the slope of the pressure drop curve in this example, as it impacted the rate of dissolution in the permeability contributing medium. It can also be noticed in this example that at very high values the results grow more insensitive to this parameter. This is most likely due in this example to the reaction becoming completely instantaneous for the given time scale. Higher reaction rate constants in this example led to faster dissolution and therefore steeper pressure drops.

Figure 14:
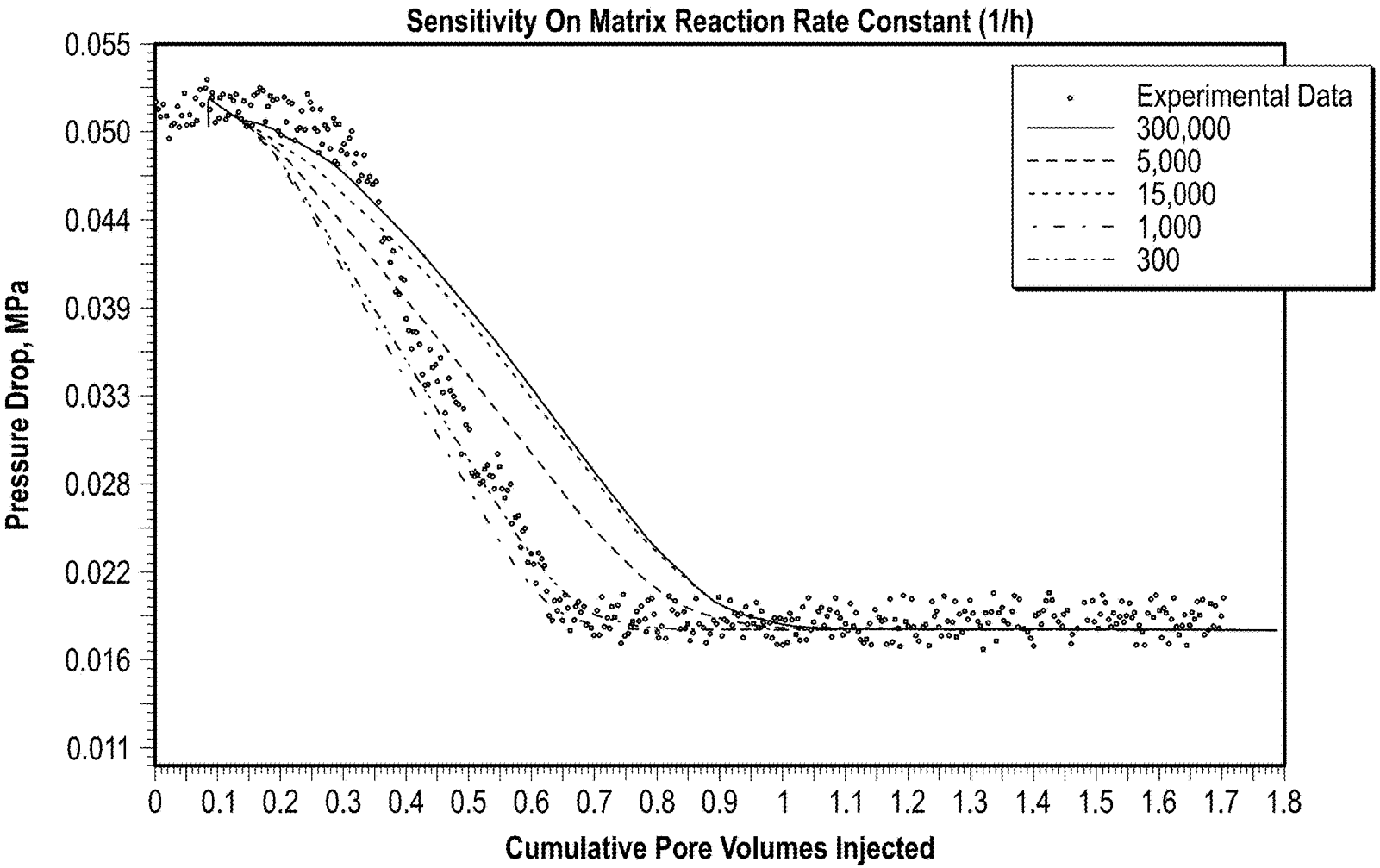
FIG. 14 is a graphical representation of a sensitivity study of the matrix reaction rate constant in the example according to embodiments of the current application.
Figure 15:
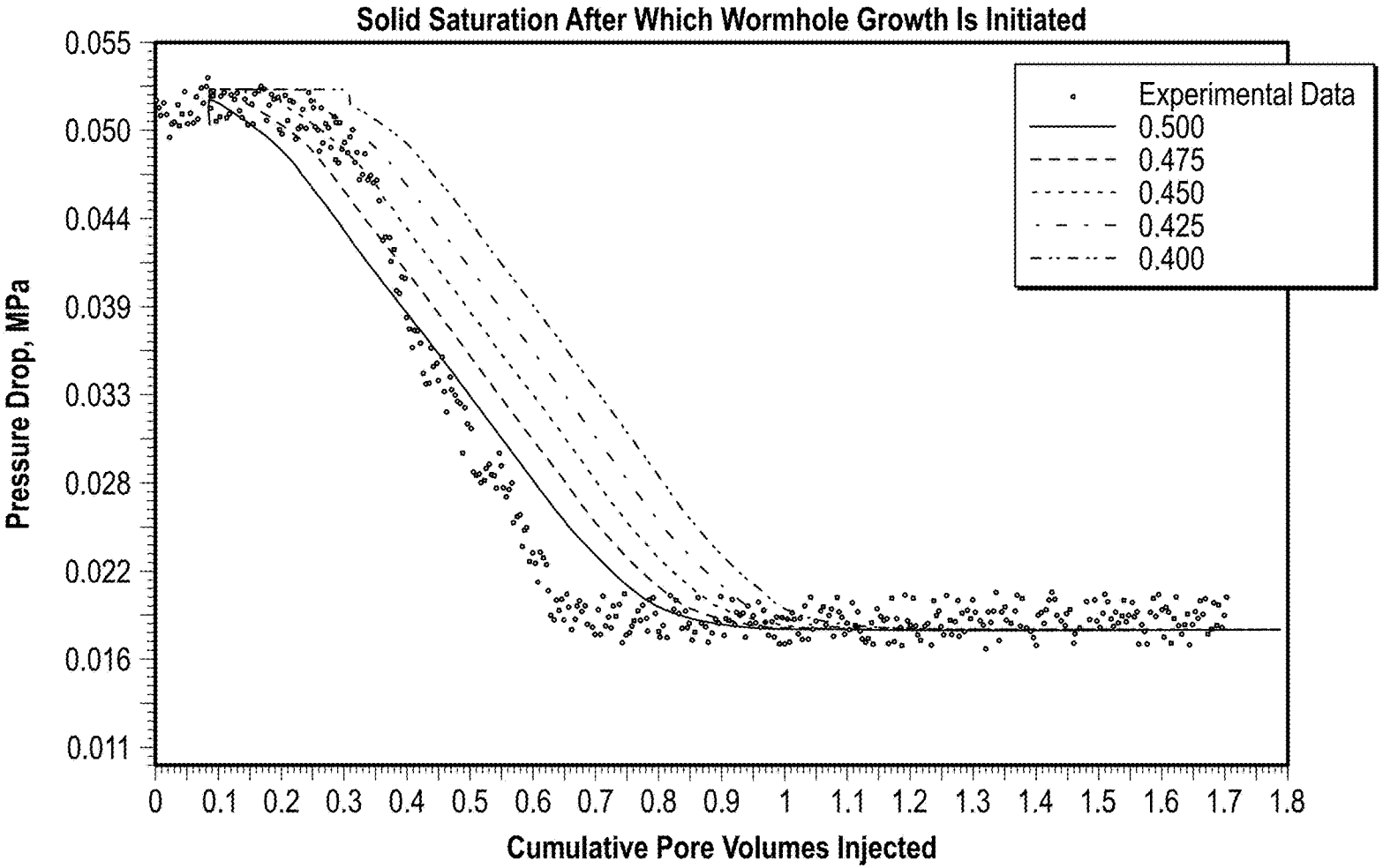
FIG. 15 is a graphical representation of a sensitivity study of the wormhole initiation saturation in the example according to embodiments of the current application.
Figure 16:
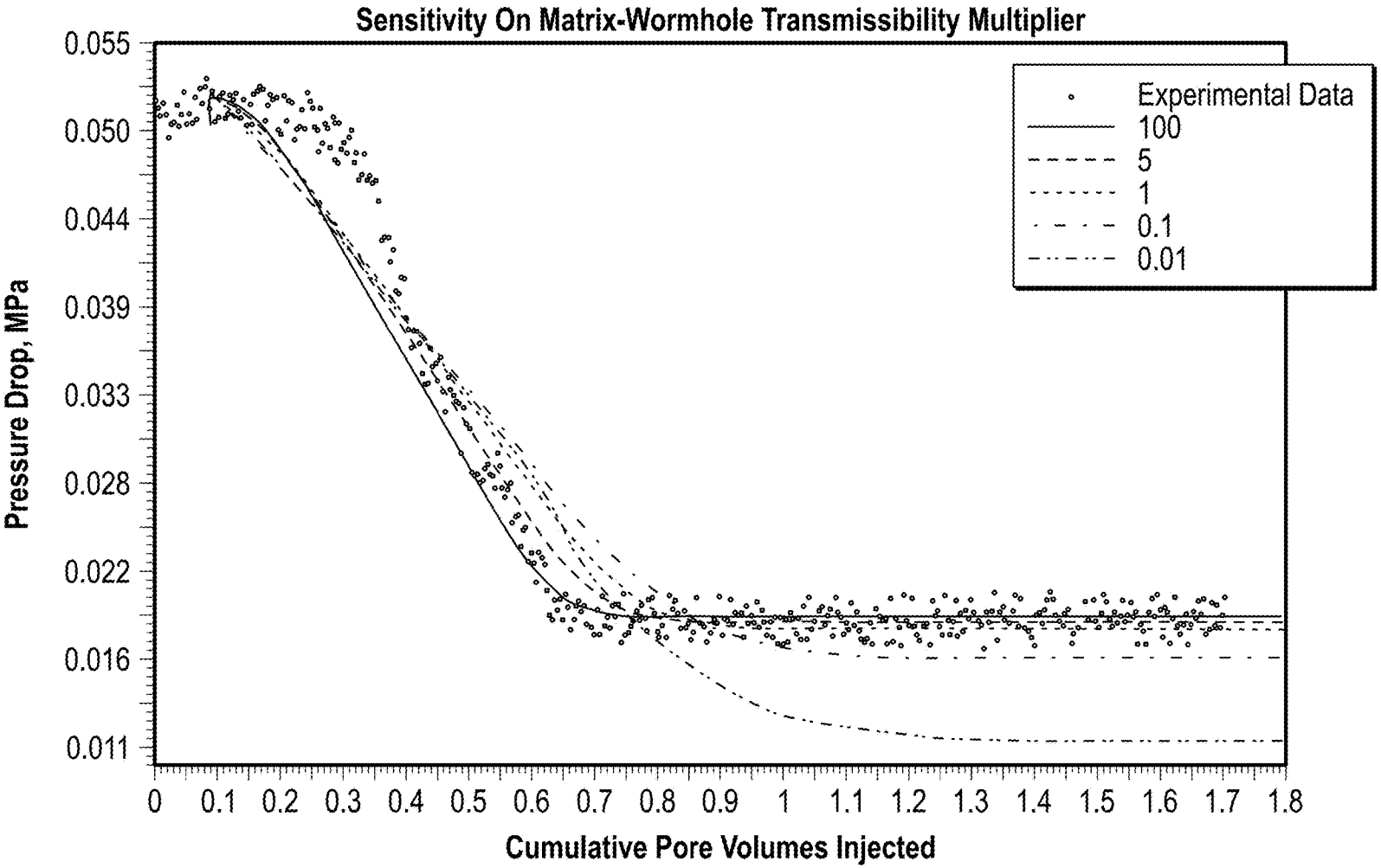
FIG. 16 is a graphical representation of a sensitivity study of the matrix—wormhole transmissibility multiplier in the example according to embodiments of the current application.

Next we considered the sensitivity of the pressure drop curve to the matrix reaction rate constant for the wormhole cells. The results are seen in FIG. 14. The base case value was 3000 l/h.

The matrix reaction rate constant in this example also impacted the slope of the pressure drop curve, although relatively less than the wormhole reaction rate constant. An interesting observation is that the two media competed for available acid, so that a higher reaction rate in the matrix in this example corresponded to less acid being available in the wormhole, therefore a lower dissolution and permeability enhancement, ultimately leading to a slower pressure drop decline.

We next considered the wormhole initiation saturation, i.e., the saturation below which the matrix cells and wormhole cells start to communicate. The results are presented in FIG. 15. Base case value for instant wormhole-matrix communication in this example was 50%.

The wormhole initiation saturation in this example can be considered as the variable which controls the extent of initial plateau: a lower value allowed for more time before the wormhole dissolution began. It is noted the slope of the pressure decline in this example, after initiation occurred, was not strongly affected, as the process continued normally.

We next considered the matrix-wormhole transmissibility multiplier, i.e., the multiplier for transmissibility between the matrix cells and the wormhole cells, also known as $\sigma$. The results are presented in FIG. 16. The base case value in this example was 1.0.

The matrix-wormhole transmissibility multiplier in this example presented a relatively small impact on the slope of the pressure drop decline curve. It affected the final pressure drop for $\sigma$ values below unity, as additional resistance was applied. With this analysis, the base case value of 1.0 was fixed for the next stage and it was not considered in the next stage of this example.

With the knowledge gained from the sensitivity studies, a manual calibration of the curve was performed next. For the 2.0 mL/min experiment, we started from the base case values and allowed for the following variables to be changed, in order of relative importance: a. Wormhole reaction rate constant; b. Closed wormhole saturation; c. Matrix reaction rate constant; and d. Open wormhole saturation. We then fine-tuned the intermediate points in the mobility multiplier versus solid saturation table if needed, and repeated until a good match of the slope was observed.

We next plotted the solid saturation for the first designated matrix cell versus the experimental pressure drop and identified the wormhole initiation saturation trigger, i.e., the variable shifting the pressure drop decline curve horizontally, as seen from the sensitivity studies. We then applied these values to the 5.0 and 7.5 mL/min experiments and compared the results against the experimental data, repeating until a consistent match was obtained for all experiments.

Figure 17:
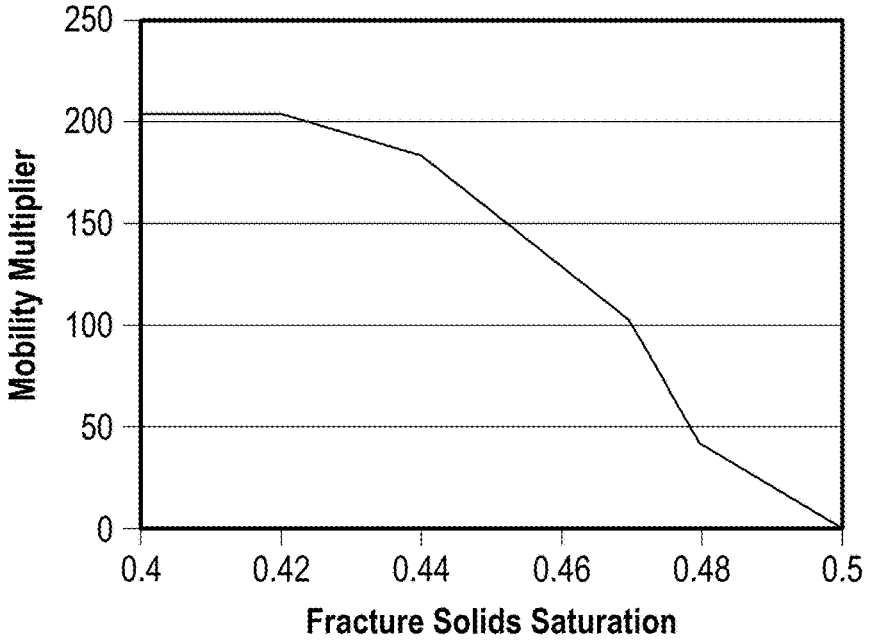
FIG. 17 is a graphical representation of a recalibrated "best match" mobility multiplier table for a wormhole as a function of solid saturation in the example according to embodiments of the current application.

The best match obtained in this example consisted of the following parameters: Matrix reaction rate constant=1,000 mL/(mol-h); Wormhole reaction rate constant=300,000 mL/(mol-h); Wormhole initiation solids saturation=48.5%; Mobility multiplier versus solid saturation table=See Table 2 and FIG. 17; and Matrix-fracture transmissibility multiplier=1.0, i.e., this was not considered as an uncertain parameter.

TABLE 2

Mobility multiplier versus solid saturation table for best match

| Mobility multiplier | Solid saturation |
|---|---|
| 203 | 0.42 |
| 183 | 0.44 |
| 102 | 0.47 |
| 41 | 0.48 |
| 1 | 0.50 |

The aforementioned parameter values in this example were then used in the simulator and the results for pressure drop profile and pore volume to breakthrough were compared against experimental results. It is worth noting that this set of parameter values in this example is not unique, but rather one possible scenario. Additional experimental measurements could further validate their use in this example.

Figure 18:
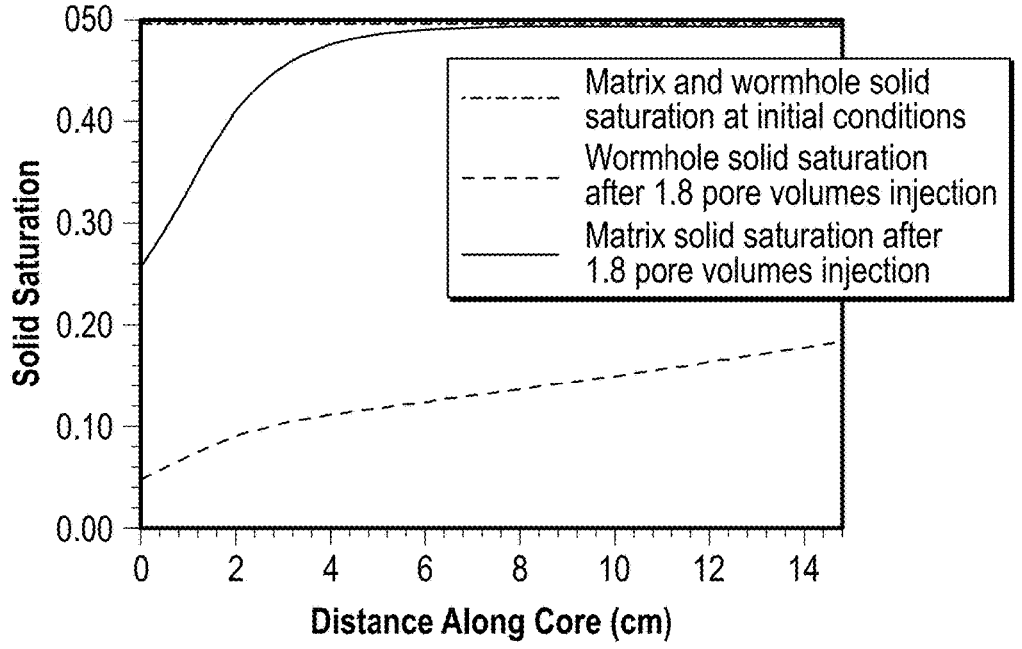
FIG. 18 is a graphical representation of the change in solid saturation in matrix cells and wormhole cells at the start and end of injection in the example according to embodiments of the current application.

Starting with a qualitative analysis, FIG. 18 displays the change in solid saturation in matrix cells and wormhole cells at the start and end of injection for the 2.0 mL/min case.

It can be seen that very little dissolution was seen at the face of the core in this example, as reflected in the short change in the matrix medium, with the wormhole progressing through the entire core, which was observed through the wormhole medium.

Figure 19:
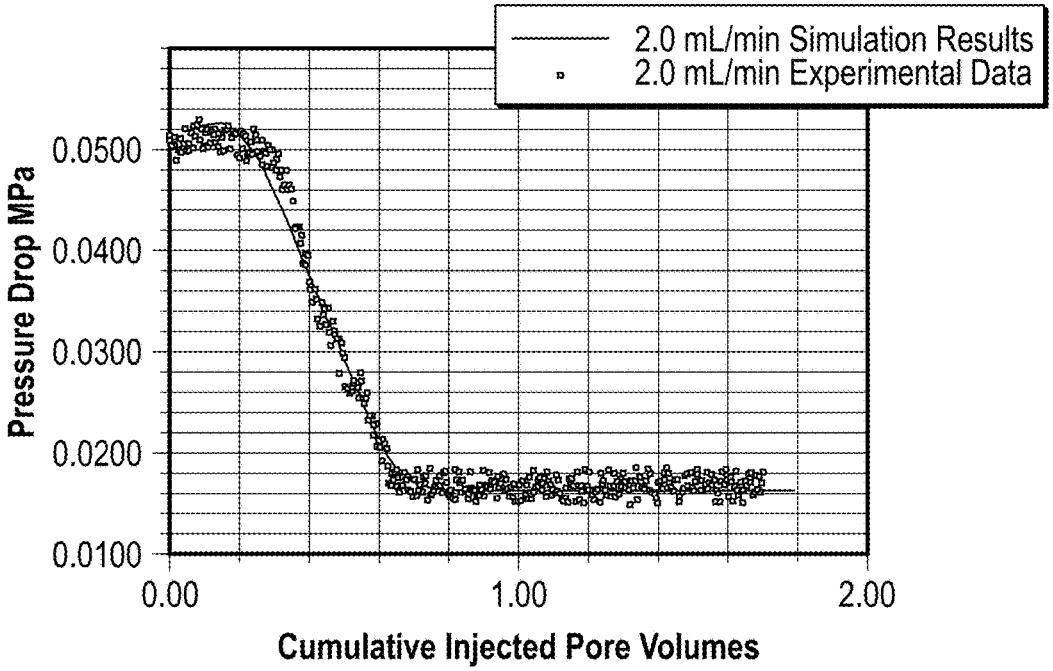
FIG. 19 is a graph comparing the simulated pressure drop curve after calibration against the experimental data for the 2.0 mL/min injection rate in the example according to embodiments of the current application.
Figure 20:
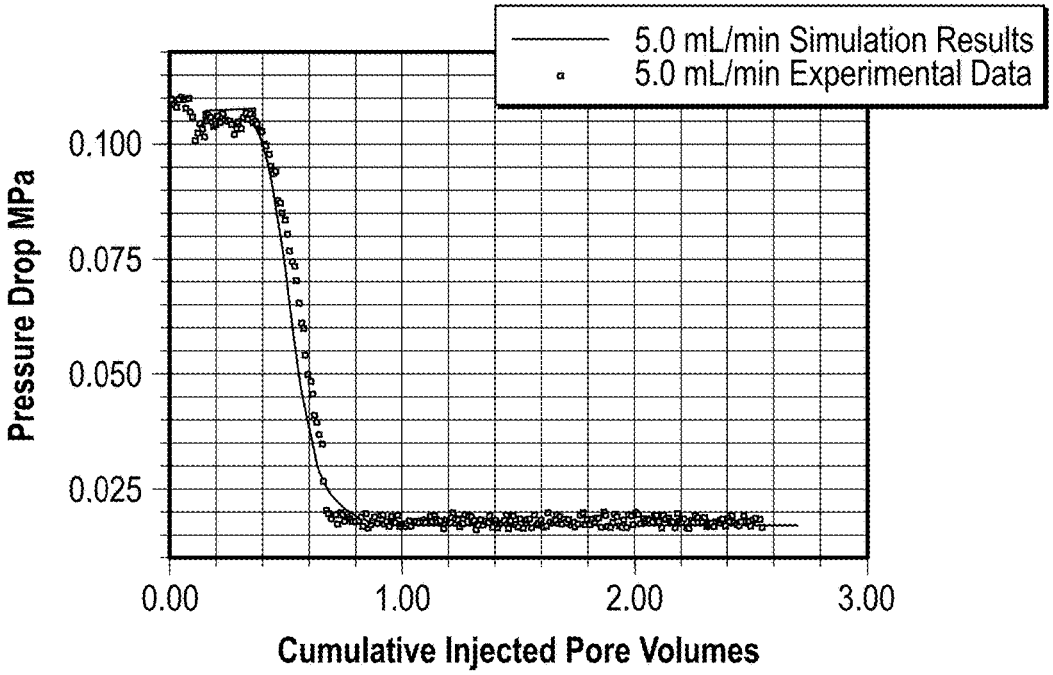
FIG. 20 is a graph comparing the simulated pressure drop curve after calibration against the experimental data for the 5.0 mL/min injection rate in the example according to embodiments of the current application.
Figure 21:
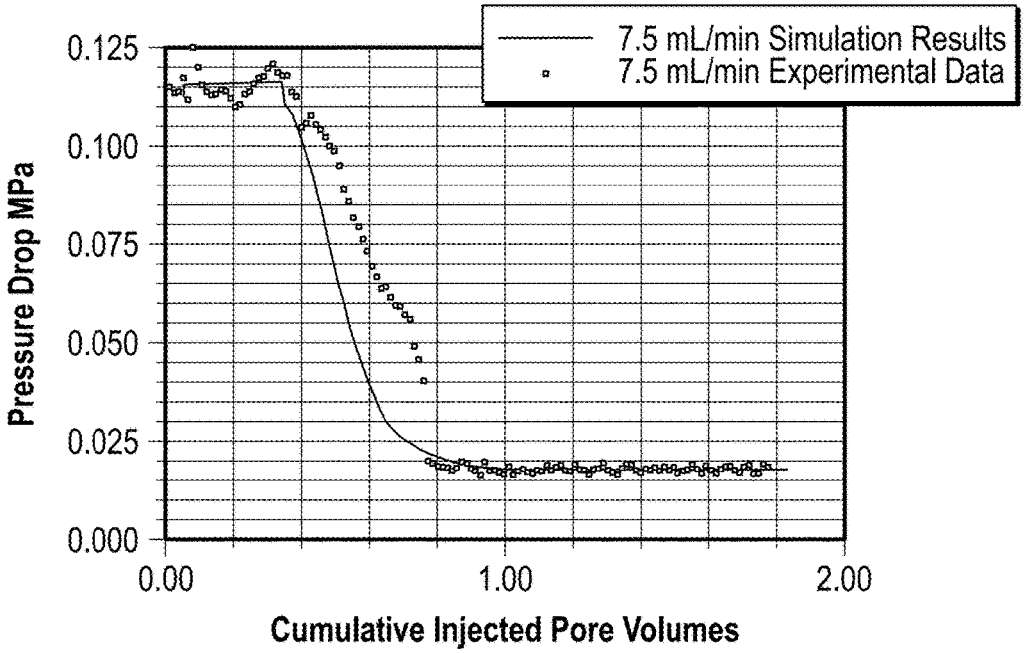
FIG. 21 is a graph comparing the simulated pressure drop curve after calibration against the experimental data for the 7.5 mL/min injection rate in the example according to embodiments of the current application.

The pressure drops for the 2.0, 5.0 and 7.5 mL/min cases obtained through simulation are plotted against experimental results in FIGS. 19, 20 and 21, respectively.

Good agreement between experimental and simulation results can be seen in the first two injection rates. The wormhole initiation model was excellent for modeling the existence of the initial pressure drop decline plateau. The slope was well represented through the dissolution process and, most importantly, the breakthrough point was well captured.

For the 7.5 mL/min results in this example, a difference in the pressure drop decline slope was observed relative to the simulation case. This may be that in this case the experimental data had two slopes, which could be attributed to unreacted acid leaking off from the wormhole tip and increasing the matrix permeability ahead of the tip. The simulator model in this example may not have been capable of capturing this detail for the chosen parameter values; however, two important characteristics showed consistency: the wormhole initiation period and the pore volume to breakthrough.

Figure 22:
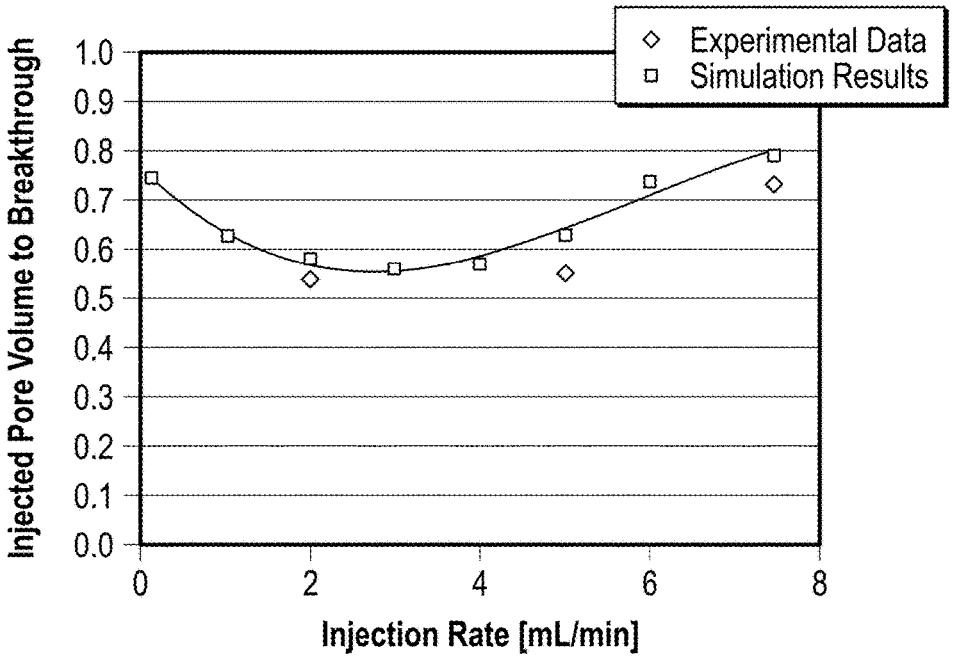
FIG. 22 is an optimization curve for the simulation results and experimental data of injected pore volume to breakthrough versus injection rate in the example according to embodiments of the current application.

With the model properly calibrated with the experimental results, the next step was preparing an injected pore volume to breakthrough versus injection rate chart. This is an effective tool for stimulation design to obtain an optimum injection rate corresponding to the injection rate where the least amount of fluid can be injected to obtain maximum permeability enhancement, which is often correlated to the formation of a single wormhole. The pore volume to breakthrough is the amount in pore volumes of acid injected after which no further significant reduction in pressure drop can be observed. In this example, these values can be plotted in the pressure drop curve seen in FIGS. 19-21. The simulations were then extended to other injection rates (0.01, 1.00, 3.00, 4.00 and 6.00 mL/min) to obtain a more detailed curve. The resulting plot can be seen in FIG. 22.

The previously noted agreement between experimental data and simulation results is reflected in this plot. Of more importance, however, is the shape of the curve with the additional simulated points, which clearly point to the existence of an optimum around the 3.0 mL/min injection rate.

This example shows that a numerical modeling procedure can be implemented on commercially available reservoir simulator to represent acid matrix stimulation according to the principles of the present disclosure. Model characteristics can include the use of dual permeability, chemical reactions, a multicomponent water phase, a solid phase and a mobility multiplier as a function of solid saturation.

In this example, the model was validated against experimental data of Pink Desert limestone samples being flooded by hydrochloric acid at different injection rates. After calibration of the model, good agreement between the experimental and simulated pressure drop profiles was achieved. Furthermore, the model was used to obtain a pore volume to breakthrough curve, from which an optimum injection rate could be seen. This provides a tool for successful acid matrix stimulation design.

The commercially available numerical simulator allowed for flexibility of use, which leads to a wide range of potential applications such as well and field scale simulation to predict production enhancement from stimulation, which may include applications with heterogeneous properties as well as different rock-fluid pairs in 1, 2 or 3 dimensions.

While the embodiments have been illustrated and described in detail in the drawings and foregoing description, the same is to be considered as illustrative and not restrictive in character, it being understood that only some embodiments have been shown and described and that all changes and modifications that come within the spirit of the embodiments are desired to be protected. It should be understood that while the use of words such as ideally, desirably, preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

We claim:

1. A method of forming a wormhole in a porous medium, comprising:

running (20) a stimulation simulator comprising:

gridding (22) a treatment region of the porous medium into a plurality of cells comprising a first portion designated as matrix cells and a second portion designated as wormhole cells;

populating (24) the simulator with static properties of the porous medium and reaction kinetic properties for reaction of the porous medium with a reactant in a treatment fluid;

modeling (26) the matrix cells wherein a medium of the matrix cells comprises matrix material behaving as a single permeability, single porosity system;

modeling (28) the wormhole cells in a wormhole initiation stage wherein a medium of the respective wormhole initiation stage cells has a solid saturation above a respective critical solid saturation and is comprised of the matrix material behaving as a single permeability, single porosity system;

modeling (30) at least a portion of the wormhole cells in a wormhole growth stage wherein the respective wormhole cells have a solid saturation equal to or less than the respective critical solid saturation, and wherein the wormhole growth stage cells comprise two different interconnected media comprised respectively of the matrix material and a wormhole material having a fluid mobility as a function of solid saturation; and obtaining (32) optimized treatment fluid injection parameters; and injecting (34) the treatment fluid into the treatment region of the porous medium according to the optimized treatment fluid injection parameters to form the wormhole.

2. The method of claim 1, wherein the stimulation simulator uses a finite difference numerical method.

3. The method of claim 1, wherein the stimulation simulator accounts for the presence in the treatment region of a multicomponent fluid selected from the group consisting of gas, aqueous and oil phases.

4. The method of claim 1, wherein the stimulation simulator accounts for the presence in the treatment region of a plurality of solid phases.

5. The method of claim 1, wherein the treatment region comprises a subterranean formation comprising calcium carbonate rock and the treatment fluid comprises acid delivered to the treatment region through a wellbore penetrating the subterranean formation.

6. The method of claim 1, wherein the fluid mobility as a function of solid saturation is specified independently for each cell to characterize different behaviors of different rock types in the respective cells.

7. The method of claim 1, wherein the wormhole initiation stage modeling accounts for dissolution of the matrix material to increase permeability and pore volume in the respective cells.

8. The method of claim 1, wherein the media of the wormhole cells in the wormhole initiation stage modeling comprise the matrix material and the wormhole material, and the wormhole initiation stage modeling further comprises assigning values to a matrix-fracture coupling transmissibility multiplier (Sigma) such that the reactant in the treatment fluid does not interact with the wormhole material.

9. The method of claim 1, wherein the media of the cells in the wormhole initiation stage modeling comprise the matrix material and the wormhole material, and wherein the wormhole initiation stage further comprises assigning initial values to a matrix-fracture coupling transmissibility multiplier (Sigma) such that reactant in the treatment fluid does not interact with the material of the wormhole material, and further comprising transitioning to the wormhole growth stage modeling by increasing the matrix-fracture coupling transmissibility multiplier above the respective initial values.

10. The method of claim 1, wherein reaction of the treatment fluid with the matrix material and, where the solid saturation is equal to or less than the respective critical solid saturation, with the wormhole material, is independently parameterized to account for dissolution of the respective material(s) in the respective cells.

11. The method of claim 1, wherein a reaction rate $R_r$ between the treatment fluid and a solid material in the cells is given by:

$$R_r V_b \cdot A_r \cdot \Pi c_{ri}^{n_{ri}} \cdot \Pi D_{mijk}$$

wherein $V_b$ is bulk volume of the respective cell, $A_r$ is a reaction rate constant, $c_{ri}$ is the product of reactant and solid concentrations, $n_{ri}$ is the order of each concentration term, and $D_{mijk}$ is an equilibrium deviation reaction term given by:

$$D_{mijk} = \theta \cdot (F_k(a_i) - C_a)$$

wherein θ is porosity of the respective cell, $F_k(a_i)$ is a function of the reactant concentration and $C_a$ is the solid concentration.

12. The method of claim 1, wherein the stimulation simulator comprises a table of mobility function versus solid saturation.

13. The method of claim 1, comprising calibrating the stimulation simulator using experimental data derived from a specimen representing rock from the treatment region.

14. The method of claim 1, comprising calibrating the stimulation simulator using experimental data derived from a specimen representing rock from the treatment region to determine a reaction rate function for reaction between the treatment fluid and a solid material in the cells and to populate a table of the fluid mobility versus the solid saturation.

15. The method of claim 1, comprising running the stimulation simulator a plurality of times to obtain datapoints comprising pore volume to breakthrough as a function of treatment fluid injection rate.

16. The method of claim 1, comprising running the stimulation simulator a plurality of times to obtain datapoints comprising pore volume to breakthrough as a function of treatment fluid injection rate to determine the treatment fluid injection rate corresponding to a minimum pore volume to breakthrough.

17. The method of claim 1, wherein the treatment region comprises a near-wellbore region of a subterranean formation, and further comprising running the stimulation simulator to determine an optimum treatment fluid injection rate to treat the near wellbore region.

18. The method of claim 1, wherein the treatment region comprises a sector of a subterranean formation, and wherein the optimized treatment fluid injection parameters comprise an optimum treatment fluid injection rate to treat the sector.

19. The method of claim 1, wherein the treatment region comprises a field of a subterranean formation, and wherein the optimized treatment fluid injection parameters comprise an optimum treatment fluid injection rate to treat the field.

20. A method, comprising:

modeling (40) a stimulation treatment involving a chemical reaction between a treatment fluid and a porous medium in a subterranean formation using a computerized model, comprising:

gridding a treatment region of the subterranean formation into a plurality of cells;

modeling the cells in a wormhole initiation stage wherein the medium of the cells having a solid saturation above a respective critical solid saturation is comprised of matrix material behaving as a single permeability, single porosity system;

modeling the cells having a solid saturation equal to or less than the respective critical solid saturation in a wormhole growth stage wherein the cells comprise two different interconnected media comprised of the matrix material and a wormhole material having a fluid mobility as a function of solid saturation; and performing a stimulation treatment in a wellbore based on the modeling.

* * * * *